US006446408B1

(12) United States Patent
Gordin et al.

(10) Patent No.: US 6,446,408 B1
(45) Date of Patent: Sep. 10, 2002

(54) COLLAPSIBLE POLE

(75) Inventors: Myron K. Gordin, Oskaloosa; Gregory Kubbe, Ottumwa; Thomas A. Stone, University Park, all of IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 09/632,962

(22) Filed: Aug. 4, 2000

(51) Int. Cl.[7] ..... E04H 12/18; E04H 12/08

(52) U.S. Cl. ..... 52/632; 52/726.4; 52/736.1; 52/745.18

(58) Field of Search ..... 52/632, 726.3, 52/726.4, 736.1, 736.4, 736.3, 745.17, 745.18, 40

(56) References Cited

U.S. PATENT DOCUMENTS

| | | | | | |
|---|---|---|---|---|---|
| 859,233 | A | * | 7/1907 | Lane | 52/11 |
| 2,243,190 | A | * | 5/1941 | Capaldo | 403/108 X |
| 2,632,850 | A | * | 3/1953 | Anderson | 52/632 X |
| 2,791,453 | A | * | 5/1957 | Baker et al. | 52/632 X |
| 2,892,647 | A | * | 6/1959 | O'Neill | 248/354.1 |
| 3,103,375 | A | * | 9/1963 | McMullin | 403/300 |
| 3,361,456 | A | * | 1/1968 | Durand | 52/632 X |
| 4,918,896 | A | * | 4/1990 | Wiese | 52/632 |
| 5,398,478 | A | * | 3/1995 | Gordin et al. | 52/726.4 X |
| 5,540,017 | A | * | 7/1996 | Eilam et al. | 52/632 X |
| 5,624,046 | A | * | 4/1997 | Zimmermann | 52/632 X |
| 6,202,369 | B1 | * | 3/2001 | Partee et al. | 52/726.3 X |

FOREIGN PATENT DOCUMENTS

| | | | | |
|---|---|---|---|---|
| CA | 627522 | * | 9/1961 | 52/632 |
| GB | 279691 | * | 11/1927 | 52/726.3 |
| GB | 586007 | * | 3/1947 | 52/726.3 |
| GB | 2272717 | * | 5/1994 | 52/736.1 |

* cited by examiner

*Primary Examiner*—Laura A. Callo
(74) *Attorney, Agent, or Firm*—McKee, Voorhees & Sease, P.L.C.

(57) ABSTRACT

An apparatus and method for elevating items includes telescopically retractable and extendable hollow tubular pole sections that include a locking means to lock at least one section in extended position. The bottom of the pole is adapted for mounting to a support structure.

40 Claims, 29 Drawing Sheets

COLLAPSIBLE POLE

BACKGROUND OF THE INVENTION

1. Field of the Invention

The present invention relates to poles, and in particular, to poles used to elevate items to substantial heights, for example greater than 35 feet.

2. Problems in the Art

Many trade-offs exist with respect to the design of poles to elevate items to substantial heights. Examples are strength versus weight; size versus wind load; weight/size versus transportability, handling, and installation ease; and materials versus costs.

Wood poles have substantial strength and are relatively inexpensive. However, they are relatively high in weight and relatively difficult to transport and handle. Likewise, concrete poles have relatively high strength but are also of high weight and are cumbersome to transport and handle.

Additionally, there are other factors, which affect the choice of poles. Examples are the type of item to be elevated; and its size, weight, and function. Another factor is the environment. Will the pole be erected outside or inside? If erected outside, will it experience high humidity or moisture? Will it experience significant winds? Another factor is the purpose of the pole. Is it permanent or temporary?

Tubular steel is a popular choice for such poles. It is relatively high strength and low weight. Through galvanization, it resists rust and corrosion and therefore can be made to be durable for even outside use. Although more costly than wood, for example, its other advantages make it an attractive choice.

Poles greater than 35' in height, even if made of tubular steel, will still present difficulties. Transportation issues exist. Some poles need to be on the order of 100' or more tall. Even semi-trailer trucks may not be able to transport such lengths, at least without special and costly permits. Although tubular steel is relatively lightweight, any item of such length is cumbersome to handle.

Additionally, once erected, it is not trivial to conduct maintenance on an item elevated by the pole. A worker many times must be elevated to the top of the pole, which requires costly and complicated equipment.

Attempts have been made to address some of these problems. Poles made and assembled in sections have been tried. Transportation and handling might be easier, but assembly requires some type of relatively complex and time consuming joint between sections.

Another attempt, commonly owned by the owner of the present application, utilizes a tapered tubular steel pole made of sections that slip fit over one another. See, for example, U.S. Pat. No. 5,398,478, incorporated by reference herein. While such a pole has been found to be very effective for certain uses, once installed, it is difficult to disassemble, modify, or move. It therefore has limited flexibility with regard to function.

It is therefore a principal object of the present invention to provide a method and apparatus, which solves or overcomes the problems and deficiencies in the art.

Other features, objects and advantages of the present invention include a method and apparatus for a pole which is:

a. Collapsible, being retractable and extendible.

b. More easily transportable, being smaller in length and compact when in a collapsed position relative to its extended position.

c. Easier to handle and manipulate and install.

d. Extendible to a lockable position.

e. Unlockable to allow retraction.

f. Retains the benefits of tubular steel.

g. Quicker and easier to install and reinstall.

h. Durable.

i. Economical.

j. Flexible regarding uses and functions.

These and other objects, features and advantages of the invention will become more apparent with reference to the accompanying specification and claims.

SUMMARY OF THE INVENTION

The present invention includes an elongated pole extendible to substantial heights. A lower end is adapted for mounting to a support. At least first and second pole sections are adapted to move relative to one another so that one nests inside the other in a collapsed or retracted position. The first and second pole sections can telescopically extend from the retracted position to an extended position. A releasable locking member or members can selectably lock the first and second pole sections into the extended position.

A further feature of the invention includes adding additional pole sections having the same attributes. Multiple pole sections can be collapsed so that all pole sections nest in a first pole section but can be telescopically extended. Releasable locking member(s) can be placed to lock each adjacent pair of pole sections. The method according to the invention includes elevating an item by telescopically extending one or more sections of a pole and locking the extended sections in position.

DETAILED DESCRIPTION OF THE PREFERRED EMBODIMENT

Figure 1:
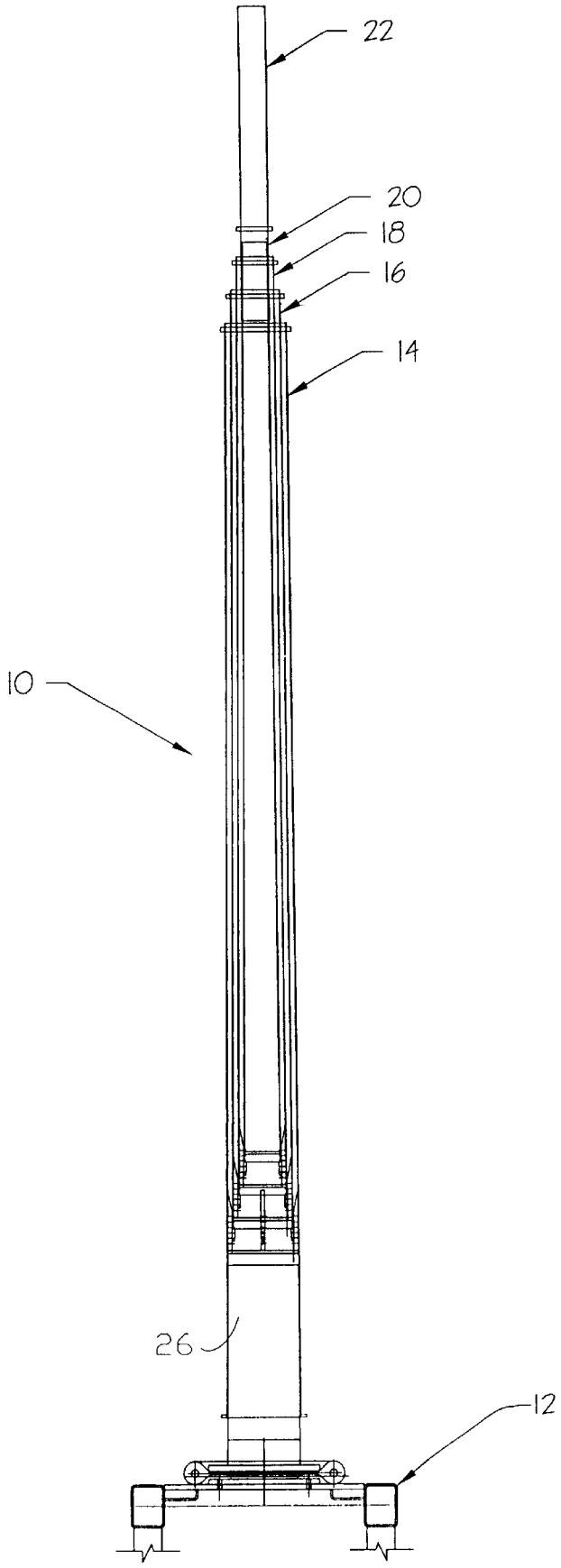
FIG. 1 is a front elevational partial sectional view of a collapsible pole, according to preferred embodiment of the present invention, shown in a collapsed position on a base.

To achieve a better understanding of the invention, one embodiment thereof will now be described in detail. Frequent reference will be taken to the drawings. Reference numbers and letters will be used in the drawings to indicate certain parts and locations in the drawings. The same reference numbers or letters will be used throughout the drawings to indicate the same parts and locations, unless otherwise indicated.

General Environment

This detailed description will discuss an embodiment of a pole that can be used for both permanent and temporary purposes. The pole will be constructed out of a plurality of telescopically moveable sections relative to a base pole section.

General Structure

FIG. 1 illustrates collapsible pole 10 according to the invention in a collapsed or retracted position on base 12. What will be called a base pole section 14 is mounted on base 12. Pole sections 16, 18 and 20 nest within base pole section 14 but have upper ends which extend outside of their immediately preceding pole section. A pole top 22 is mounted at the top of pole section 20. Pole top 22 does not move relative to pole section 20.

Figure 2:
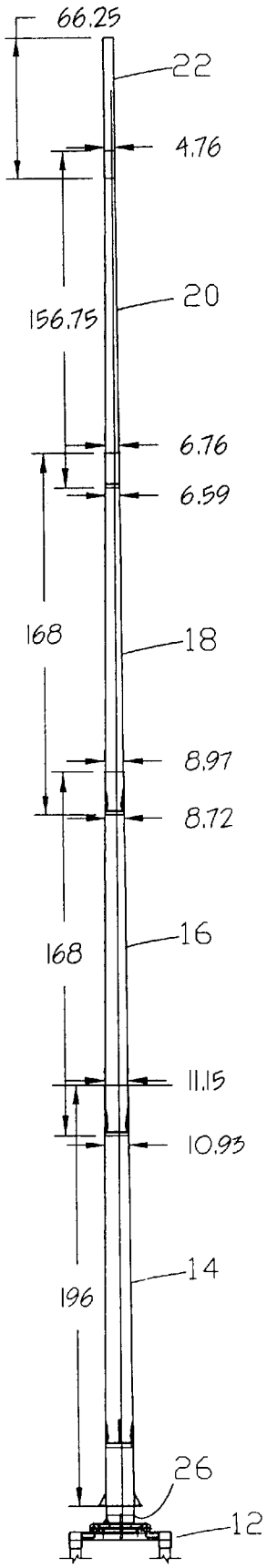
FIG. 2 is similar to FIG. 1 but is a reduced in size version showing pole of FIG. 1 in a fully extended position.

FIG. 1 is a sectional view and illustrates the nesting of sections 16, 18, and 20 within section 14. In comparison, FIG. 2 shows pole 10 in fully extended position. Pole sections 16, 18, and 20 are telescopically extended. As can be seen, in an extended position pole 10 appears to be a unitary tapered pole from top to bottom, as opposed to a sectional pole. Also, as can be seen comparing FIGS. 1 and 2, the fully extended height of pole 10 is well over twice that of pole 10 in collapsed or retracted form (FIG. 1).

Figure 3:
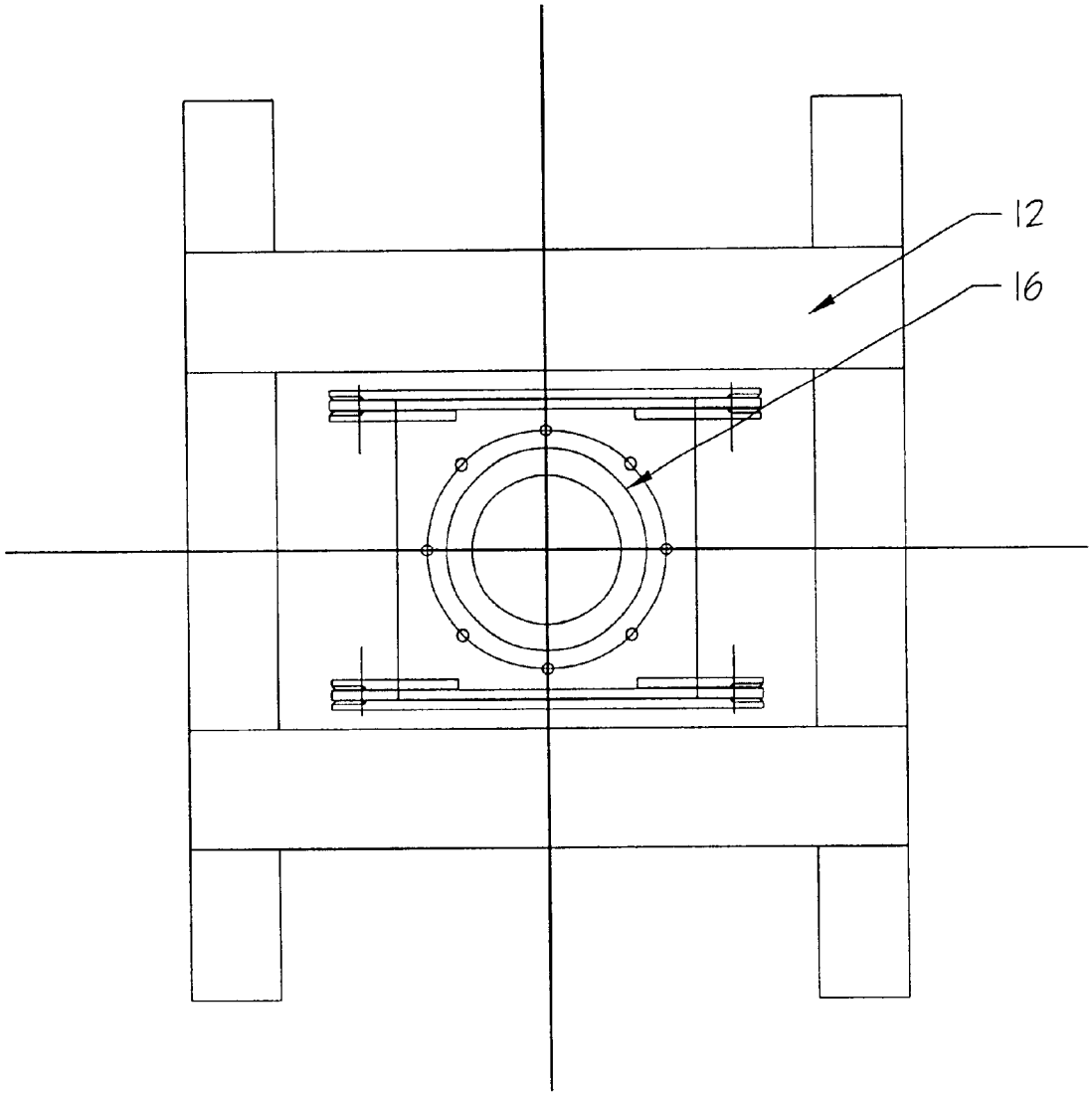
FIG. 3 is a top plan view of FIG. 1.
Figure 4:
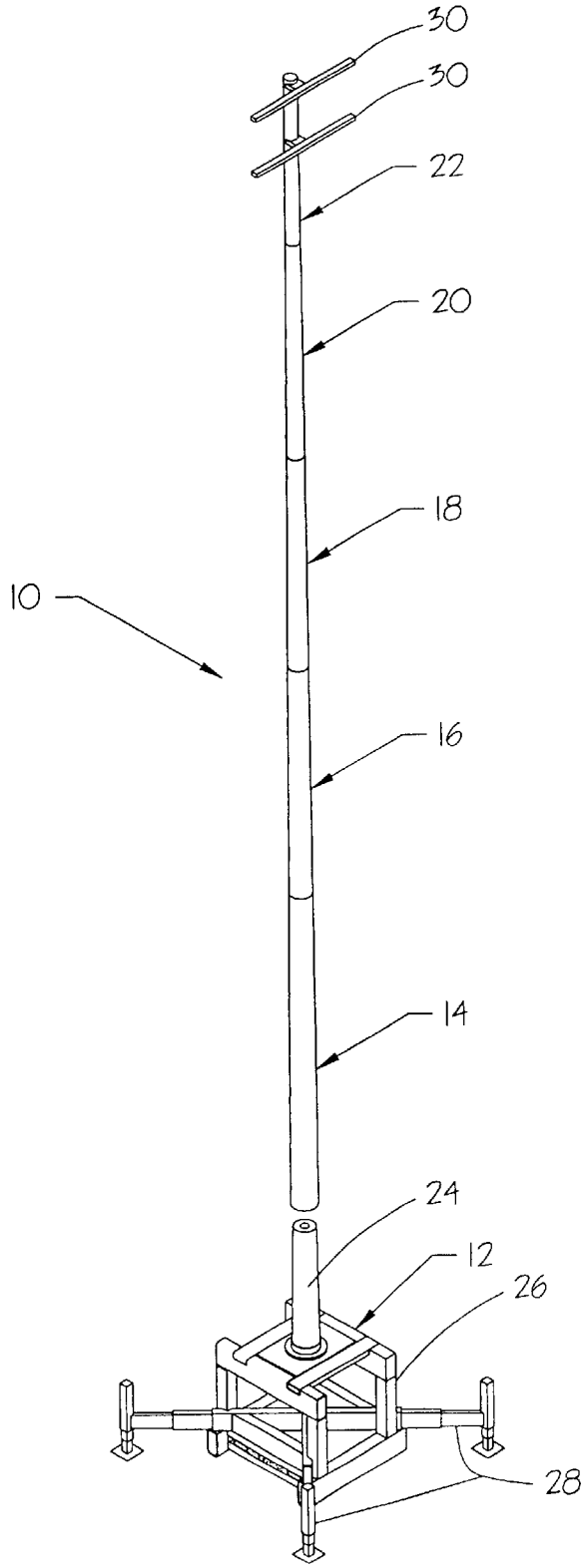
FIG. 4 is a reduced in scale perspective view of an example of a portable base with the pole of FIG. 1, and shows cross arms at the top of the extended pole.

FIG. 3 is a top plan view of FIG. 1 showing pole 10 on a moveable base 12. By further reference to FIG. 4, it can be seen that base 12 can be a portable framework 26 including an upwardly extending tapered stub 24 mounted in the framework 26. Base pole section 14 can be removably slip-fit over stub 24 to mount pole 10 in place. Outriggers 28 can be used to provide a relatively large footprint to resist over-turning moment. A substantial amount of weight and/or equipment can be placed in the interior frame 26 to further support pole 10 or to provide such things as electrical power or components, for example, for operation of lights that could be mounted on cross-arms 30 could be attached to pole top 22. For more specifics regarding base 12 of this type, reference can be taken to co-owned, co-pending U.S. Ser. No. 09/217,975, which is incorporated by reference herein. An example of a pole top 22 can be seen at co-owned U.S. Pat. No. 5,600,537 which is incorporated by reference. It is to be understood, however, that base 12 could also be a permanent base. Stub 24 could be permanently and rigidly mounted in the ground or in some other supporting structure. For examples of such base, reference can be taken to co-owned issued U.S. Pat. No. 5,398,478, which is incorporated by reference herein.

Pole 10 is made of tubular steel (0.120–0.179" thick). Pole 10 may or may not be galvanized and may be made of different material (e.g. aluminum, Fiberglas, carbon epoxy, etc.) Each pole section 14, 16, 18, and 20 is tapered at the following rate—0.14" per longitudinal foot, with the very bottom of base pole section 14 having a 13.40" diameter and the very top of pole section 20 having a 4.76" diameter. As shown in FIGS. 1 and 2, this allows pole sections to nest within one another (FIG. 1) with substantial room between each section when nested. However, when extended, pole 10 looks like it is a unitary tapered pole from top to bottom. Most of the room between sidewalls of each of the adjacent pole sections is reduced as they are extended.

Table 1 below sets forth dimensions of pole 10.

| Section | Length | Bottom-Most Diameter | Top-Most Diameter |
|---|---|---|---|
| 14 | 196" | 13.40" | 10.93" |
| 16 | 168" | 11.15" | 8.72" |
| 18 | 168" | 8.97" | 6.95" |
| 20 | 156.75" | 6.76" | 4.76" |
| 22 | 66.25" | 5.14" | 5.00" |

As a general rule, in the fully extended position of FIG. 2, the overlap between adjacent pole sections should be 1½ diameters minimum. Retracted pole 10 is less than 25' long. Extended, it is on the order of 60' tall. Of course, a variety of sizes are possible.

As will be discussed further, releasable locks mounted on pole 10 lock adjacent pole sections in place in extended position. This additional structure is added to the pole and pole sections, but is relatively minimal in nature and weight, is non-complex, and is durable. Therefore, pole 10 obtains essentially the characteristics of a hollow tapered steel pole, but is sectional in nature, can be collapsed, and therefore can be more easily transported and handled in a collapsed state as opposed to a single piece pole of size of FIG. 2. Stress remains relatively constant from top to bottom of pole 10 when extended. Wind drag is smallest at the top because of the tapering of pole 10.

Furthermore, pole 10 can be removed from base 12 and thus stored, shipped and handled separately from base 12 until it needs to erected.

There is no need for extremely accurate tolerances between pole sections. Therefore, conventional commercially available tubular steel sections are readily available and are more economical because no exact tolerances are needed.

Specific Structure

Figure 5:
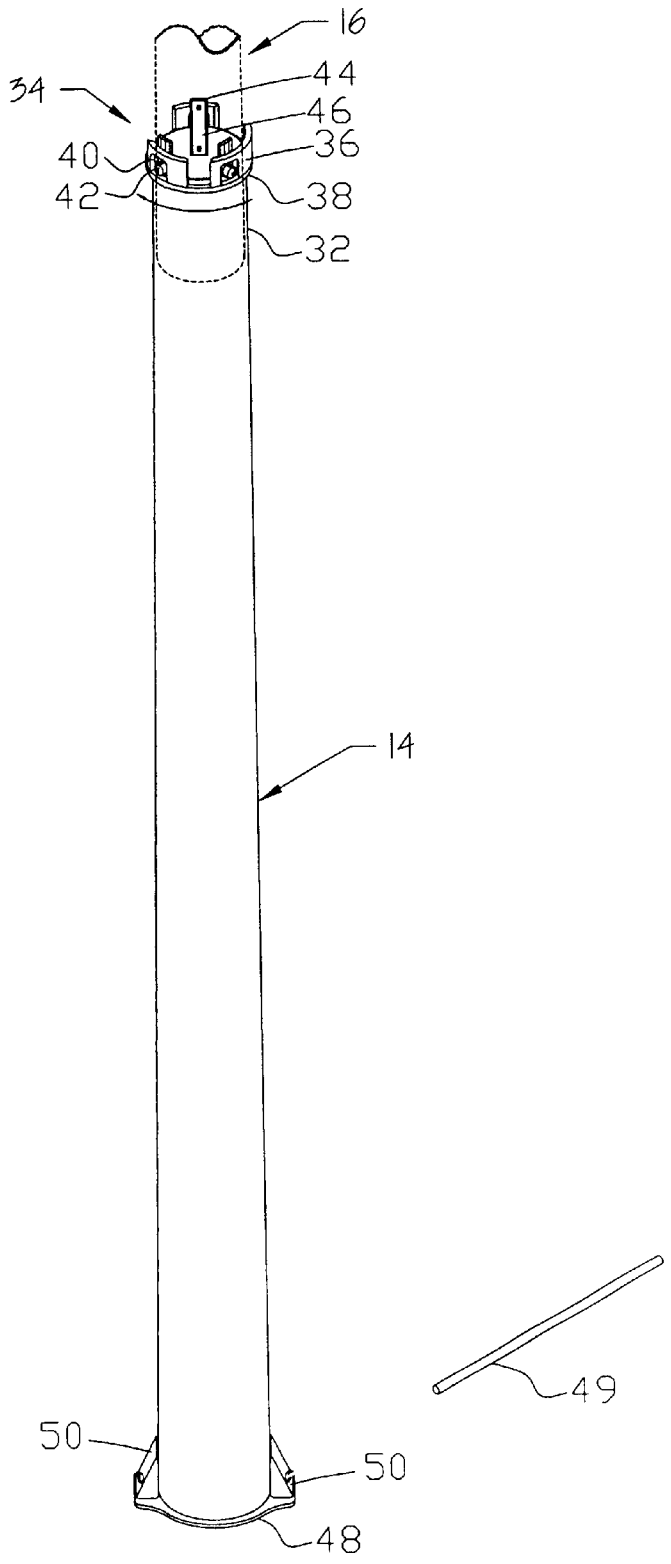
FIG. 5 is enlarged isolated perspective view of a preferred embodiment of a bottom-most pole section of the pole in FIG. 1 with a succeeding pole section in extended position and a pole rotation tool shown in ghost lines.

FIGS. 5–23 show specific structure of pole 10. FIG. 5 illustrates base pole section 14. Its upper end 32 including a locking mechanism (indicated generally at 34). Locking mechanism 34 releasably locks pole section 14 and pole section 16 (shown in ghost lines) in extended position relative to one another.

Locking mechanism 34 consists of three latch catches or plates 36 fixed (e.g. 120 degrees apart) on a annular ring 38 welded to the top 32 of base pole section 14 at equally spaced apart positions. Each latch catch 36 is essentially curved to follow the curvature of the upper end 32 of base pole section 14 and includes generally a rectangular opening 40.

Locking mechanism 34 also includes spring-loaded catch pins 42 mounted in catch pin blocks 44 which are in turn mounted by screws or bolts to the interior of the lower end of pole section 16. Catch pins 42 extend through openings in the lower end of pole section 16 and are mounted to correspond in position with latch catches 36 on base pole section 14.

In the position of FIG. 5, with pole section 16 fully extended and catch pins 42 aligned with openings 40 of latch catches 36, each catch pin 42 is biased outwardly by a flat spring attached to the back of catch block 44 so that they extend radially outwardly of the diameter of the top 32 of base pole section 14, catch pins 42 thus prevent longitudinal movement of pole section 16 relative to base section 14, to lock the two pole sections in an extended position.

As will be described in more detail later, catch pins 42 can be retracted to releasably disengage locking mechanism 34 and allow pole section 16 to move longitudinally downward and collapse or retract into base pole section 14. Catch pins 42 are retracted radially inward of the inside diameter of the top 32 of base pole section 14 to allow such movement.

FIG. 5 also shows base pole rotation ring 48, welded to the lower end of base pole section 14 and having an annular opening approximately the size of the bottom opening of base pole section 14 (not shown), and base pole turning gussets 50. This arrangement allows a tool (manual or mechanized) to be inserted therein (e.g. an elongated metal pole or rod 49, see FIG. 5) to grab or connect to the bottom of base pole section 14 to allow it to be rotated. Such rotation is either used when seating pole 10 on stub 24 of base 12, or when turning base pole section 14 to lock or unlock pole sections of pole 10 as will be discussed later. A washer (e.g. plastic) or other friction-reducing member could be placed between section 14 and base stub 24.

Figure 6:
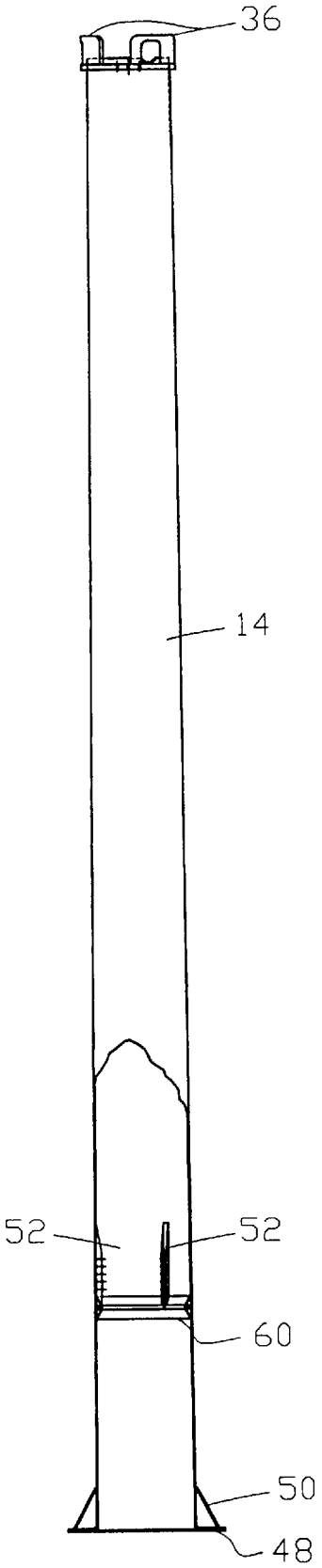
FIG. 6 is a side elevational and partial interior cut away view of FIG. 5.
Figure 7:
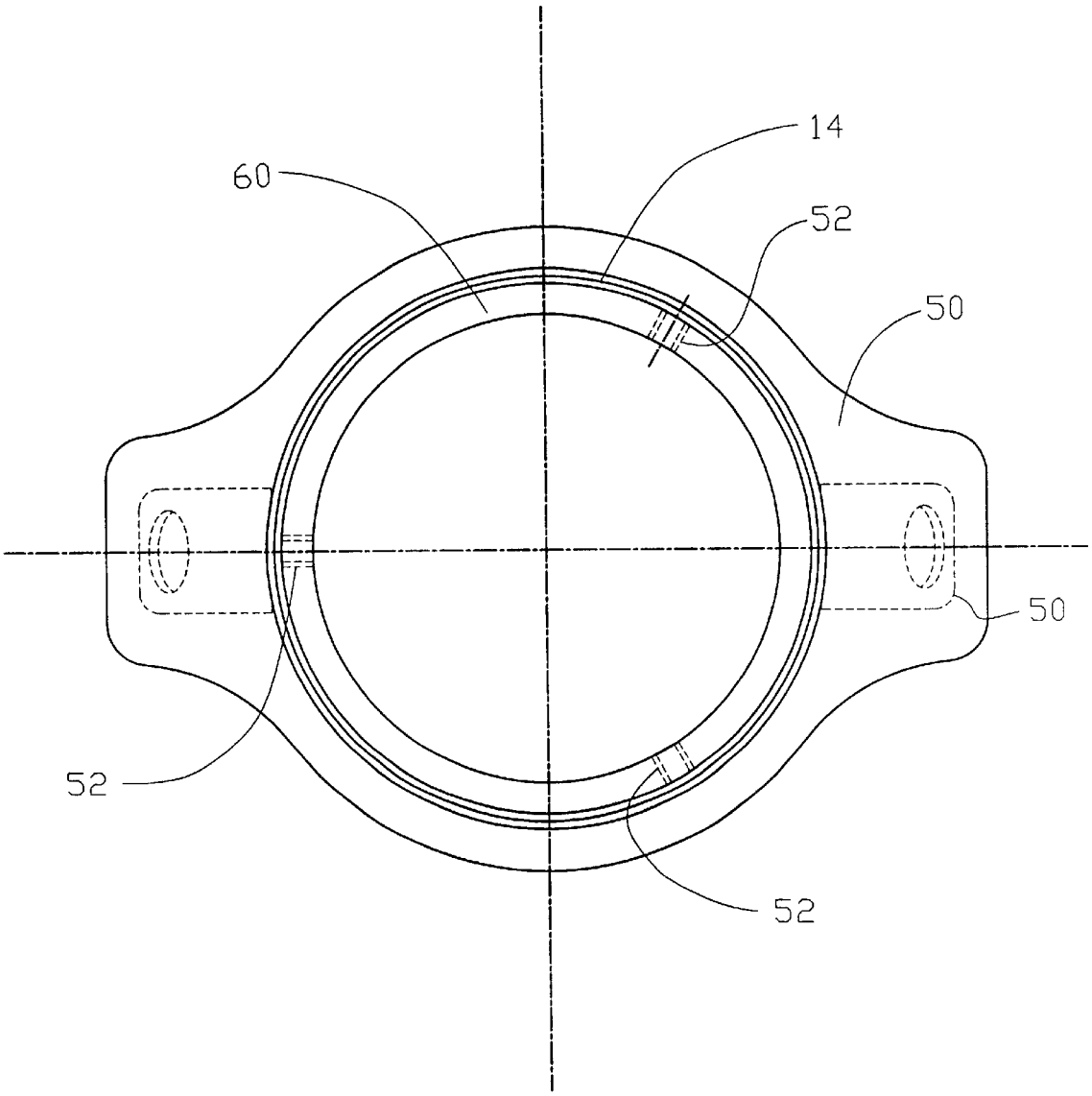
FIG. 7 is an enlarged bottom plan view of FIG. 6.
Figure 8:
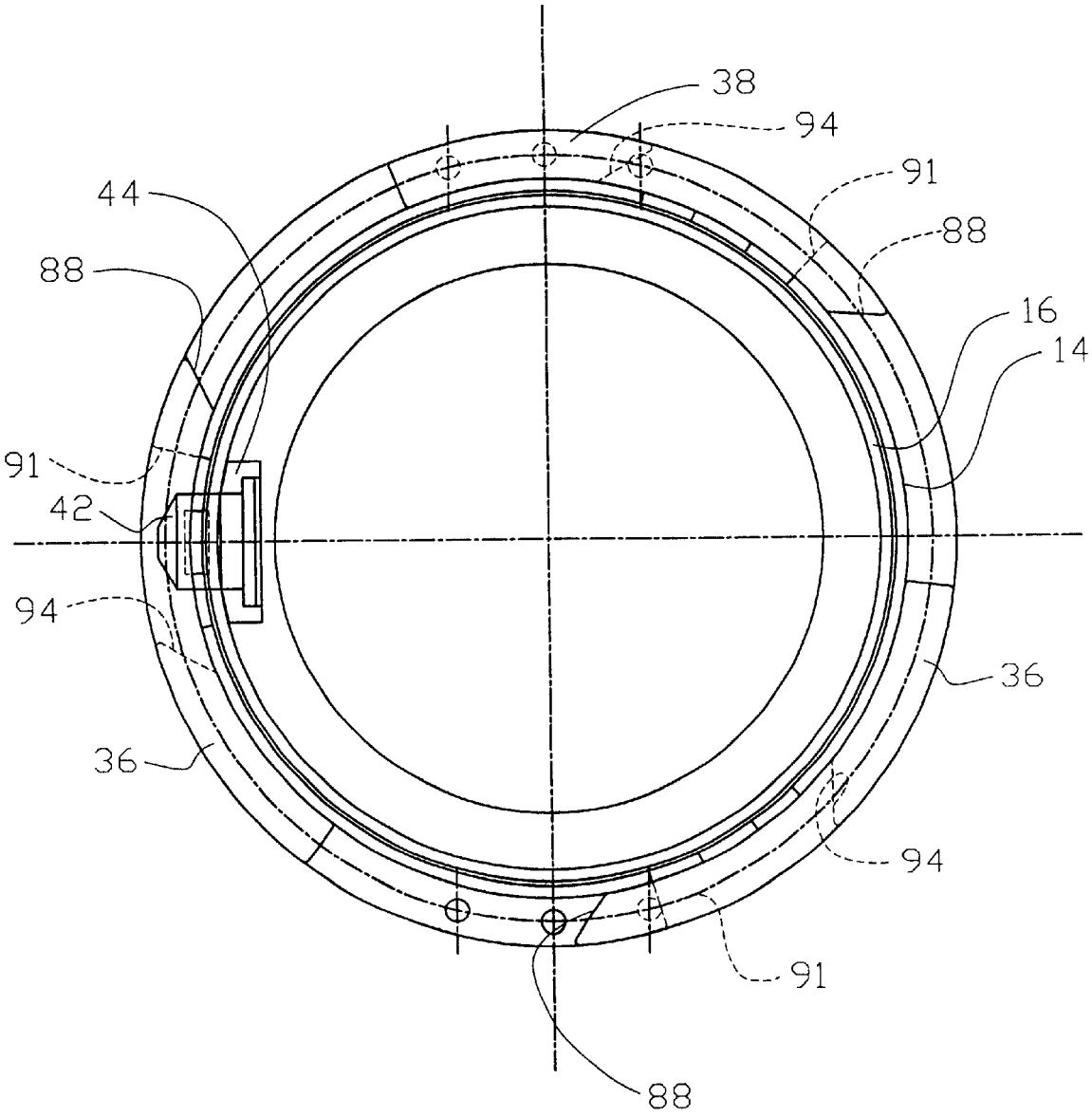
FIG. 8 is an enlarged top plan view of FIG. 6 also showing a catch pin and succeeding pole section in place.
Figure 9:
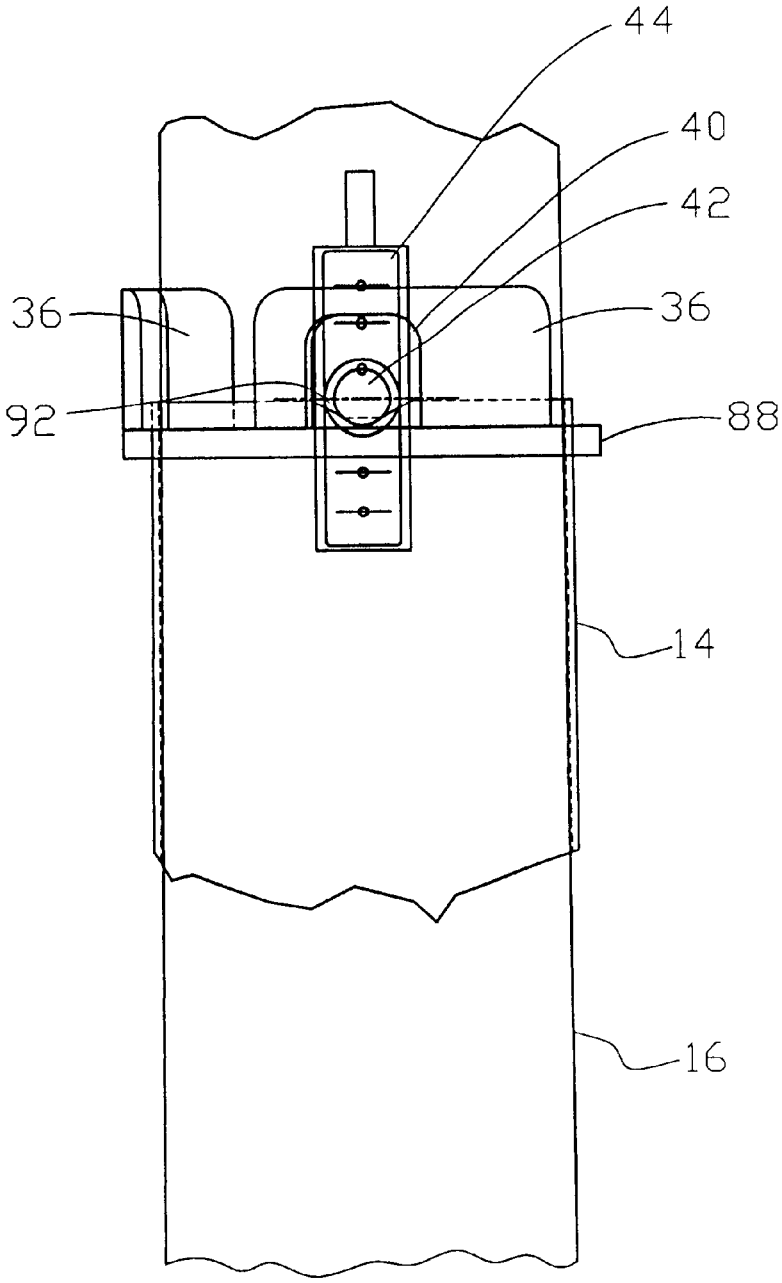
FIG. 9 is an isolated side elevational view of the top of FIG. 6.
Figure 10:
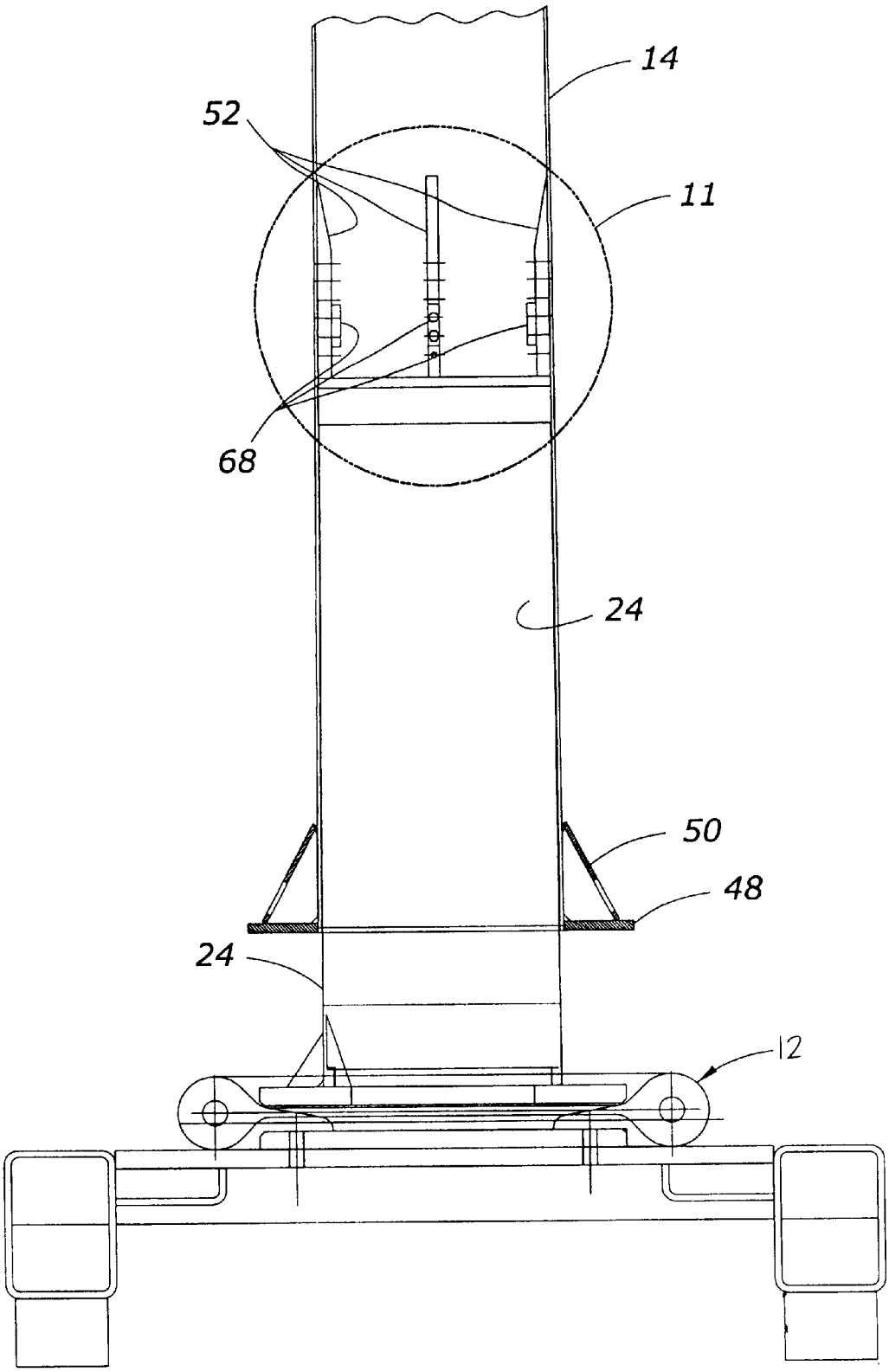
FIG. 10 is an enlarged partial sectional view of the bottom portion of FIG. 2.
Figure 11:
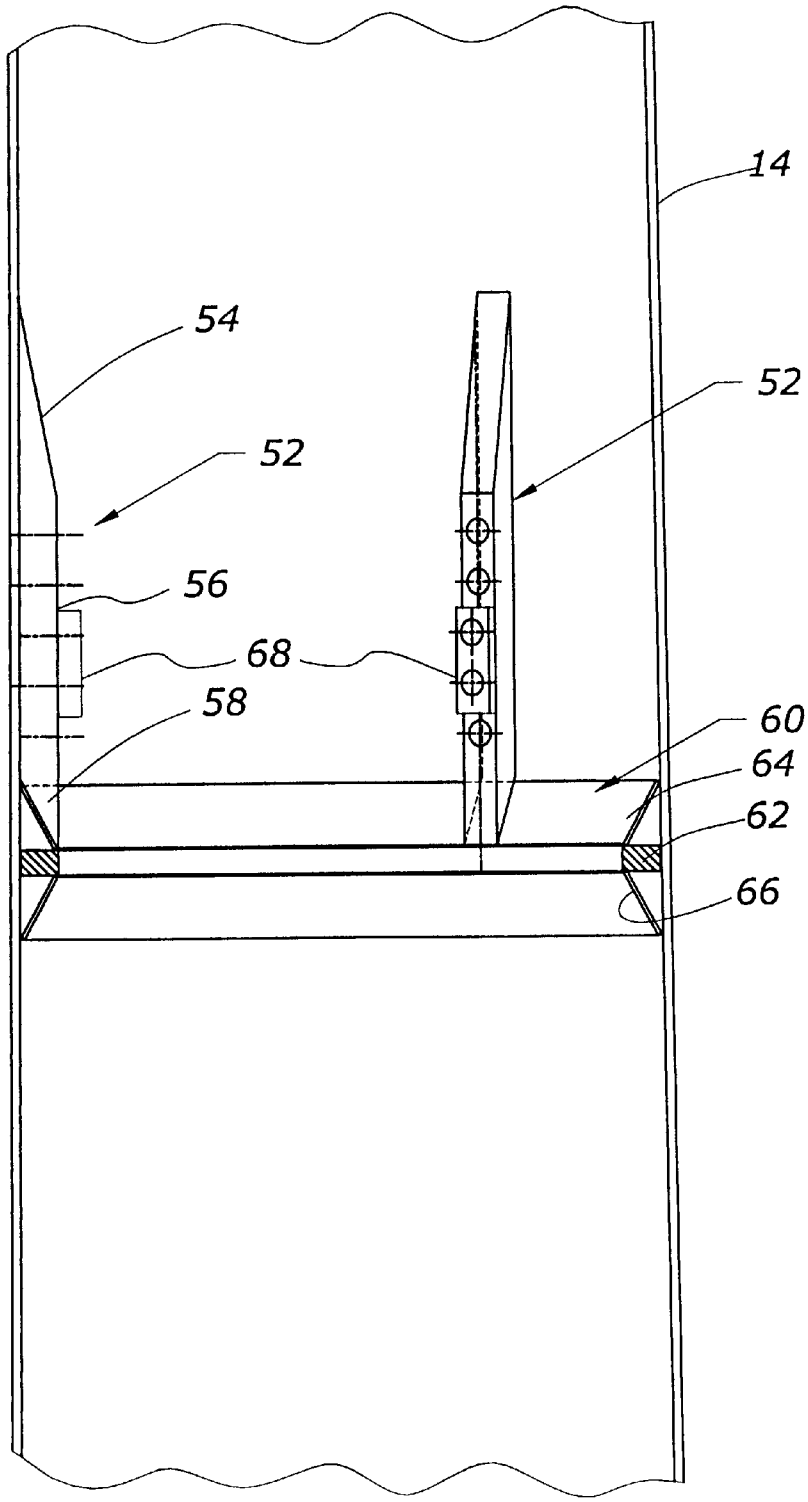
FIG. 11 is still a further enlarged view of the region shown by dashed line 11 in FIG. 10.

FIGS. 6–11 show additional details of base pole section 14 and locking mechanism 34. Additionally, as shown at FIGS. 6, 10, and 11, interior centering ramps 52 can be screwed, bolted, or welded to the interior of base pole section 14, near its bottom. Each centering ramp 52, with a ramp portion 54, a middle section 56, and a bottom section 58, abuts a constriction 60 (see particularly FIG. 11). Constriction 60 is comprised of a solid annular reinforcing ring 62 welded to the interior of section 14, with adjacent opposite sloped rings 64 and 66. Ring 62 forces the pole section to be round. Centering ramps 52 serve to center and retain the lower end of pole section 16 when retracted to its lower most position, as shown in FIG. 1. Constriction 60, with sloped rings 64 and 66, allows pins 42 of another pole section to cam action over ring 62 during extension or retraction of that pole section.

The tapering of pole 10 results in the gap between base pole section 14 and pole section 16 to increase the farther pole section 16 is collapsed or retracted into section 14. Thus, centering ramps 52 are particularly valuable to retain pole sections when collapsed and deter damage, rattling, or forces that might cause any pole section to go out of round, including during shipment and handling.

As shown in FIG. 11, a stop block 68 can be welded or otherwise secured to middle portions 56 of centering ramps 52. Stop blocks 68 would function as a lower limit or stop to limit how far down into base pole section 14, pole section 16 can collapse or retract.

As shown in FIG. 10, the position of restriction 60 and centering ramps 52 would be high enough in base pole section 14 that they would not interfere with stub 24 of base 12 when base pole section 14 is fully seated and installed on stub 24.

Figure 12:
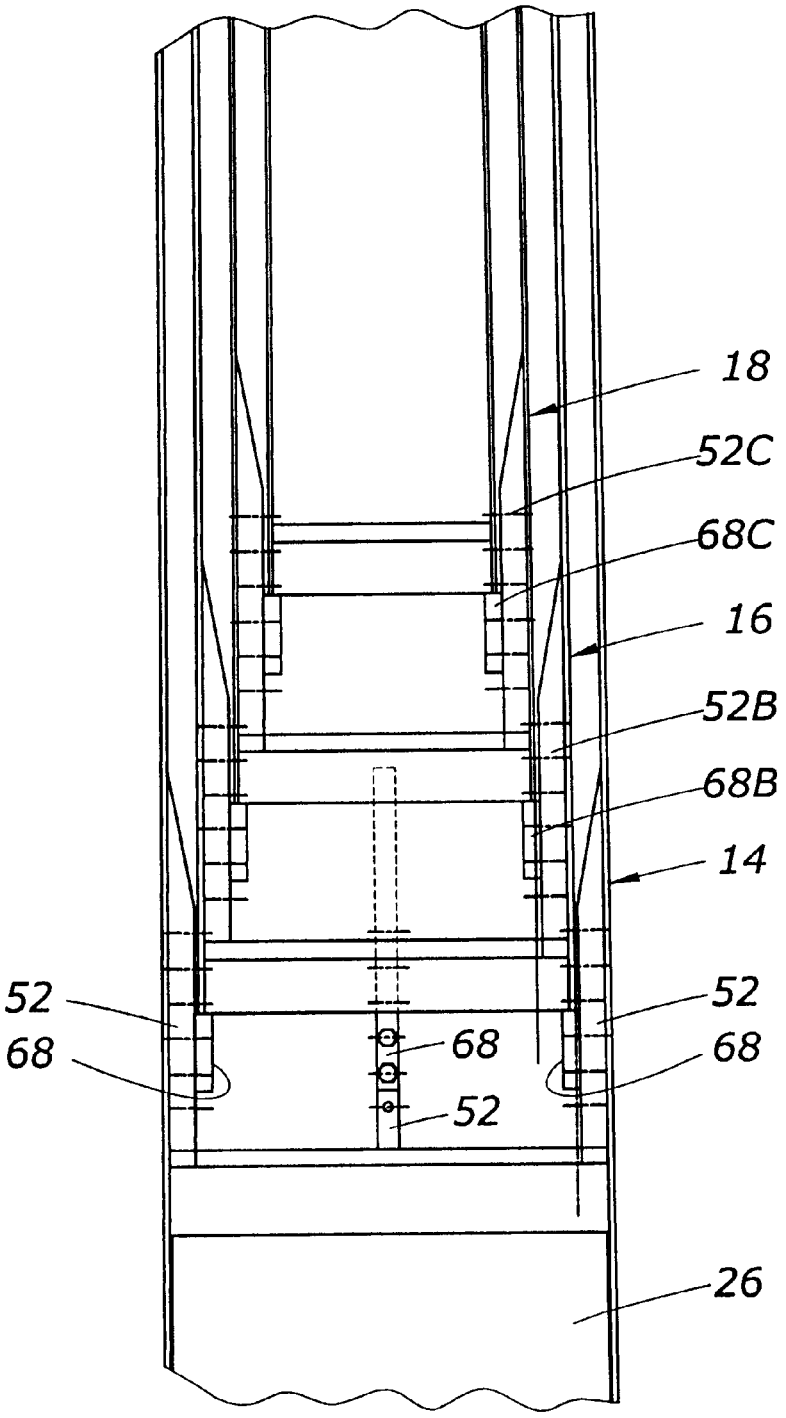
FIG. 12 is an enlarged view of the region shown by dashed line 12 in FIG. 1.

FIG. 12 illustrates that a similar arrangement can be used for succeeding pole sections in pole 10. Centering ramps 52B with lower limit/stop 68B can be attached to the lower interior end of pole section 16. When pole section 18 is collapsed into pole section 16, centering ramps 52B center pole section 18 and lower limit/stop 68B defines how far it can be retracted relative to pole section 16.

The same structure can be built into the lower interior end of pole section 18 (see centering ramps 52C and lower limit/stop 68C) relative to pole section 20. FIG. 12 thus shows how pole 10, when in collapsed or nested form, results in centering and support of the lower end of succeeding pole sections in a preceding pole section. Also, if desired, centering ramps 53 (like ramps 52) could be attached at spaced apart positions around the tops of the pole sections (other than the bottommost pole section) to help center the tops when collapsed (see FIG. 13 for examples). Still further if desired, a small ear or piece could be affixed to an adjacent pole section and in between ramps 52 (or 53) to limit rotation of one of the sections relative to the other (e.g. limit rotation to approximately 120 degrees because the ear would come into abutment with a ramp 52 (or 53) if it were attempted to rotate a pole section outside the angular range between ramps 52 (or 53); in this embodiment 120 degrees.

As can be easily understood, these structural relationships, in combination with the lengths of the pole sections, can be designed so that when in the fully collapsed position of FIG. 1, the upper-most ends of each of pole sections 16, 18, and 20 extend outside of their immediately preceding pole section so that even in collapsed form, some portion of each pole section is available and accessible from the exterior of pole 10. This allows each pole section to be individually grasped from the exterior for extension purposes, as will be discussed in more detail later.

Figure 13:
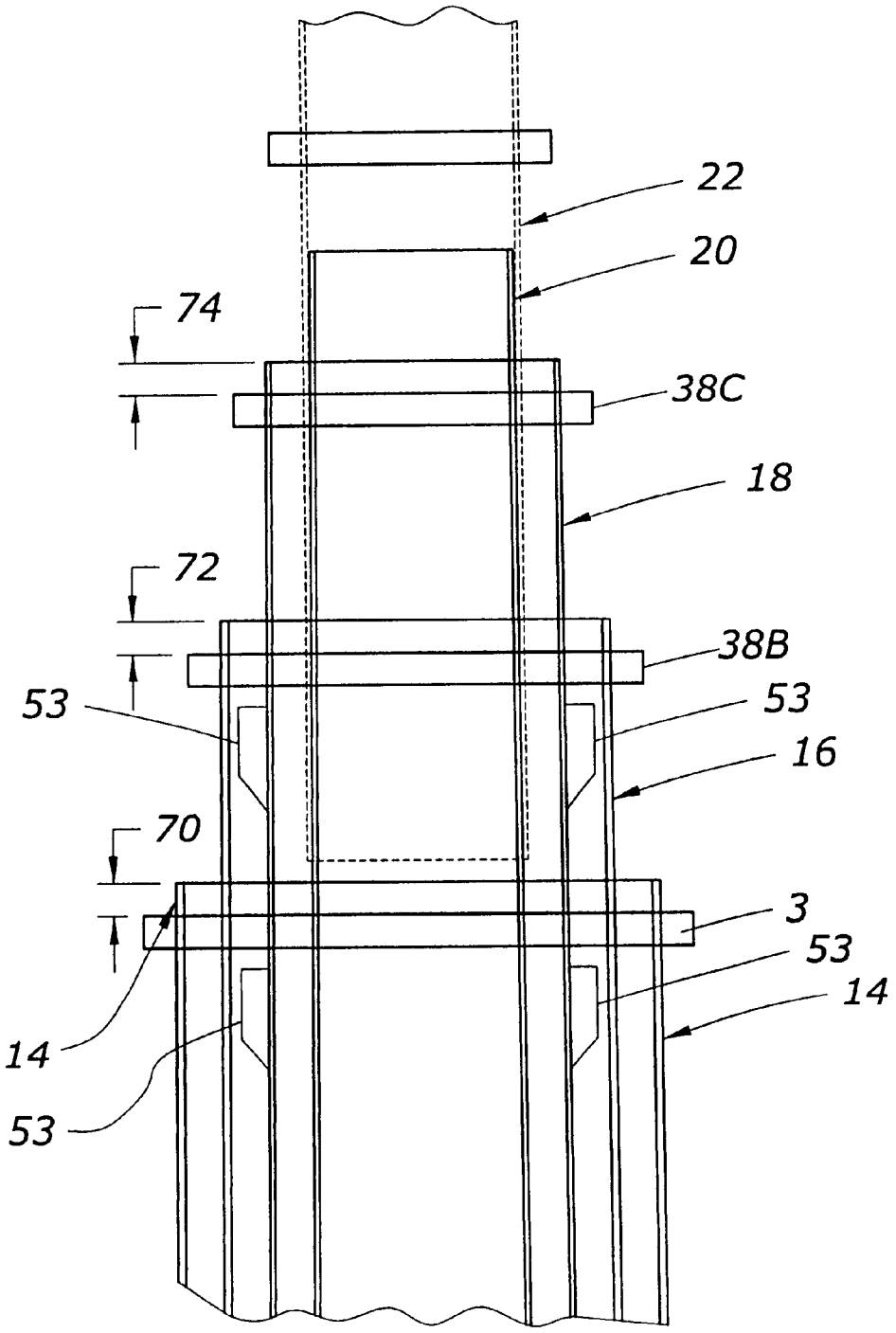
FIG. 13 is an enlarged view of the region shown by dashed line 13 in FIG. 1.
Figure 14A:
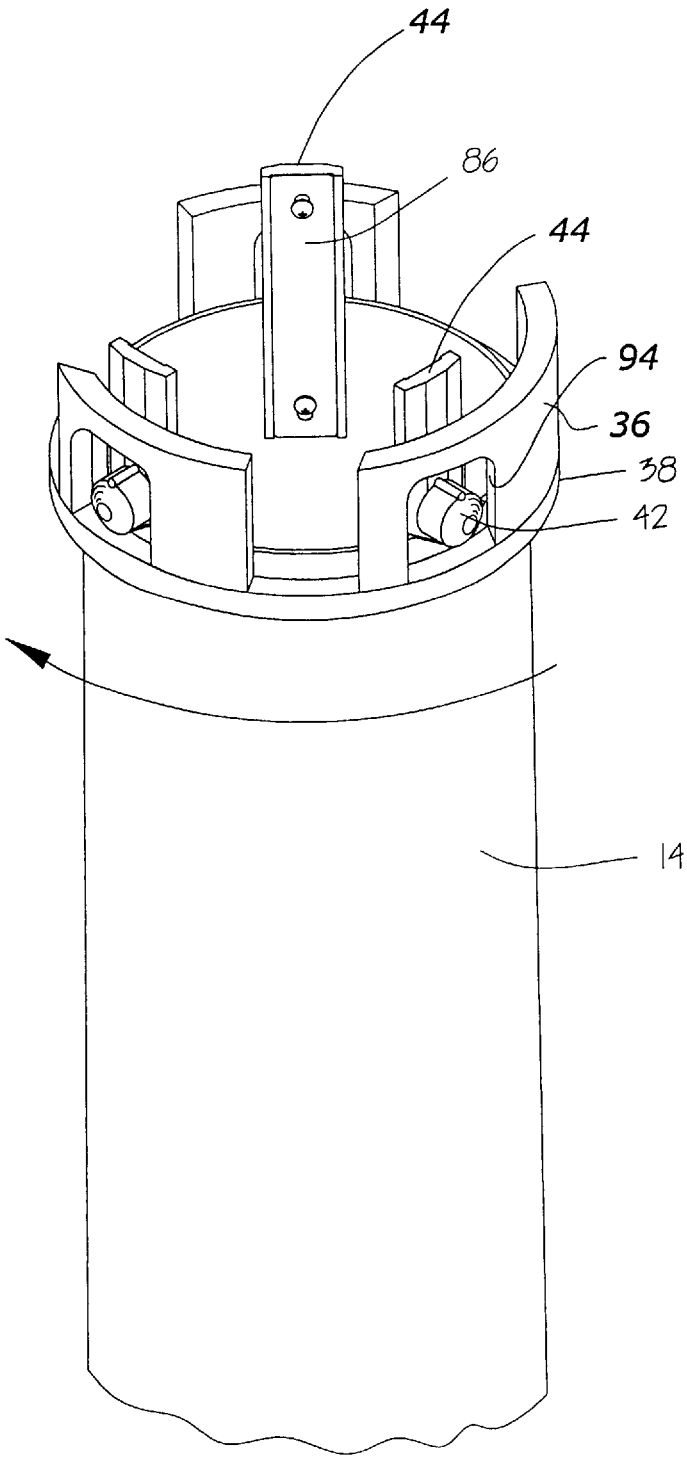
FIG. 14A is an enlarged view of the top part in FIG. 5.
Figure 14B:
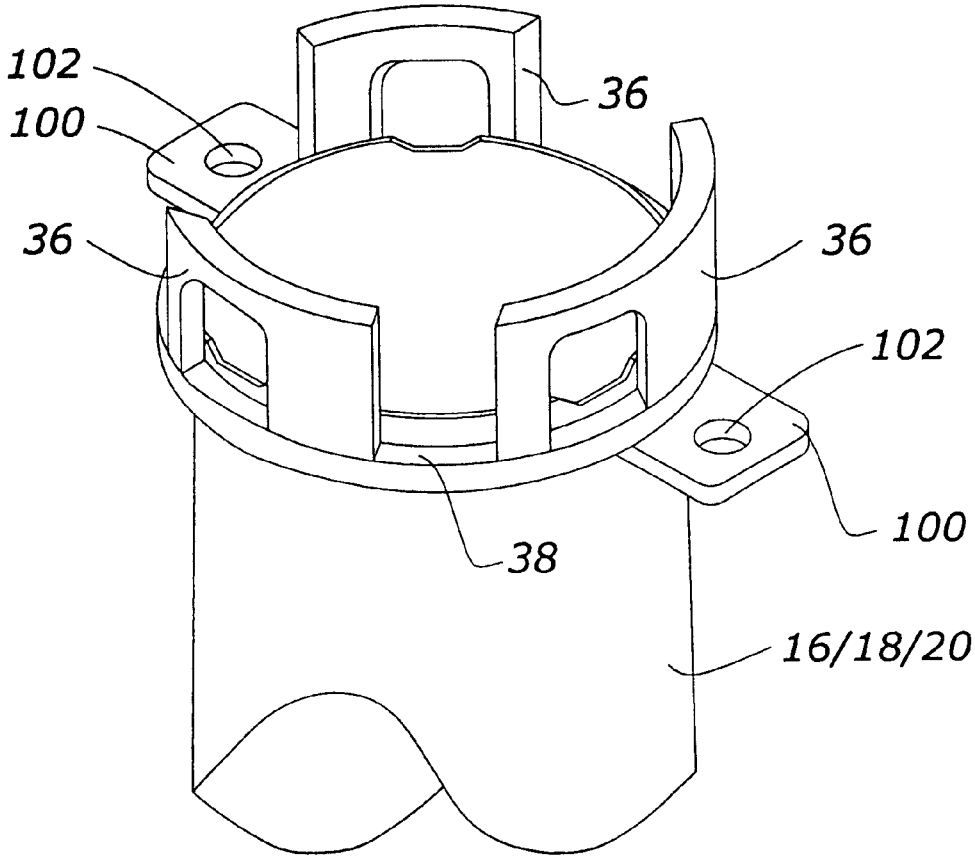
FIG. 14B is an enlarged view of the top of a collapsible pole section showing grasping ears that can be used to grab the section to extend it or retract it.
Figure 15:
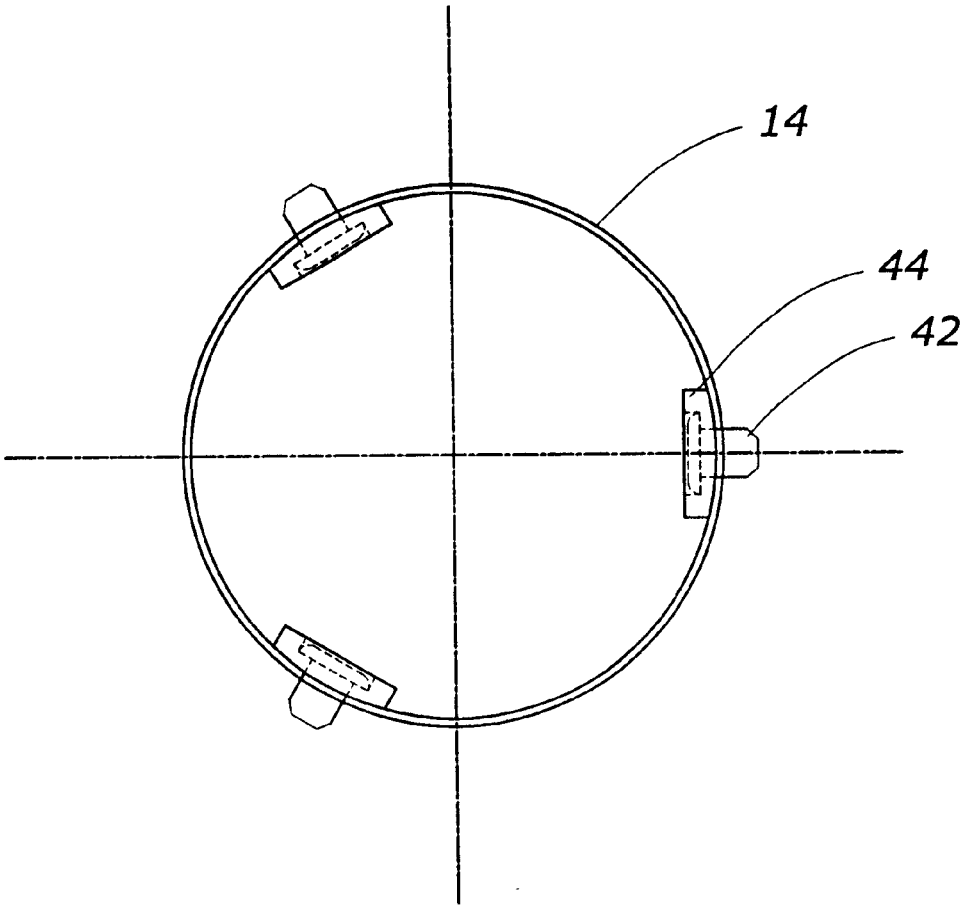
FIG. 15 is a bottom plan view of the bottom of pole section that telescopically nests within the base pole section in FIG. 6.
Figure 16:
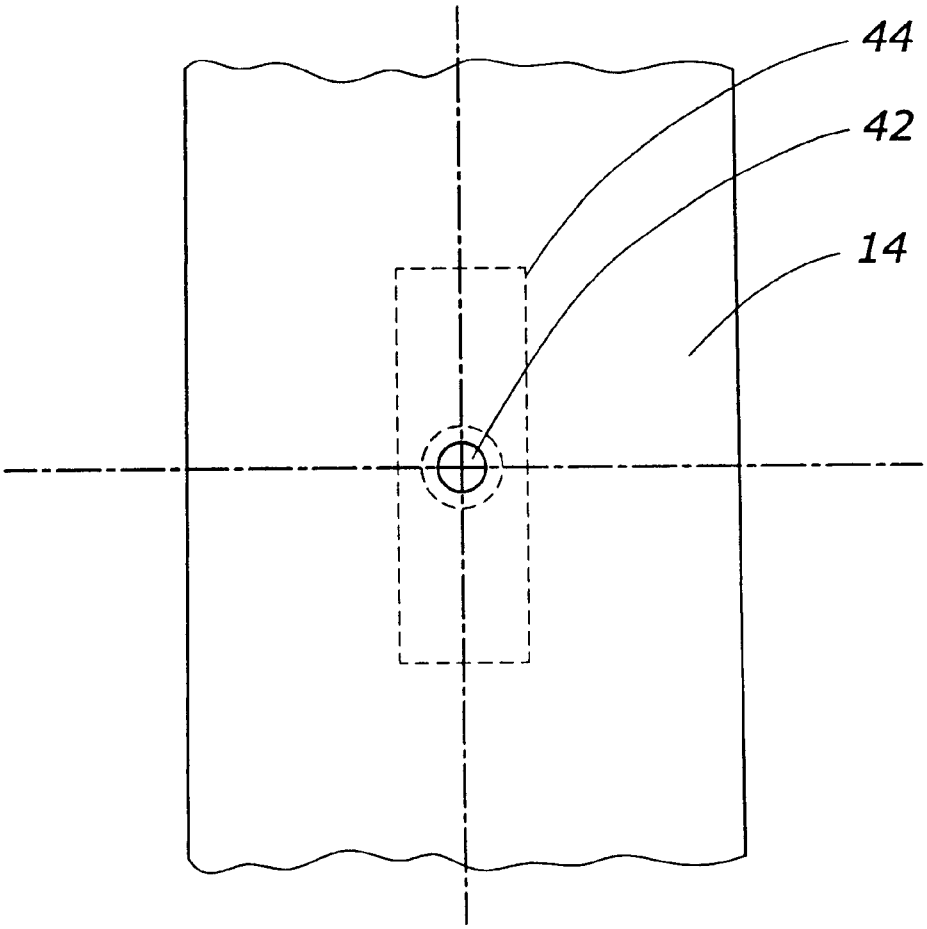
FIG. 16 is a side elevational view of FIG. 15.
Figure 17A:
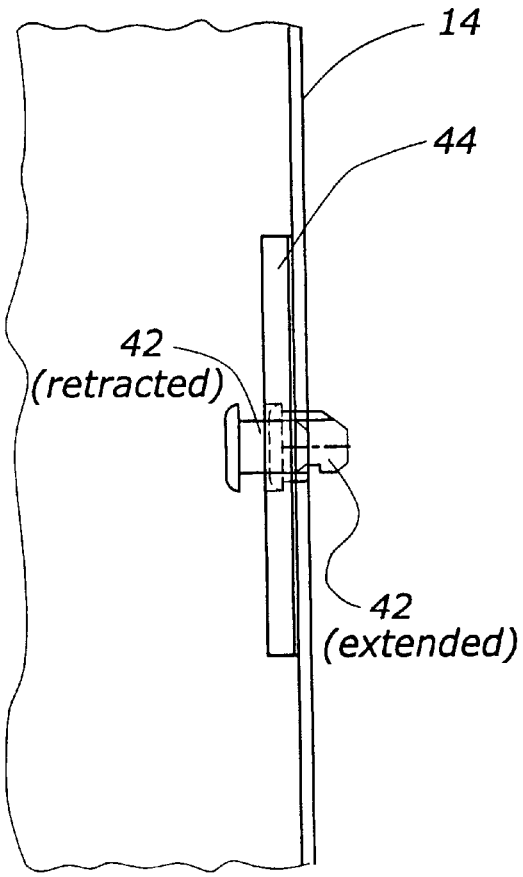
FIGS. 17A and B are side and front elevational views of a locking pin shown in FIGS. 15 and 16 with FIG. 17A showing the pin in retracted and extended positions.
Figure 17B:
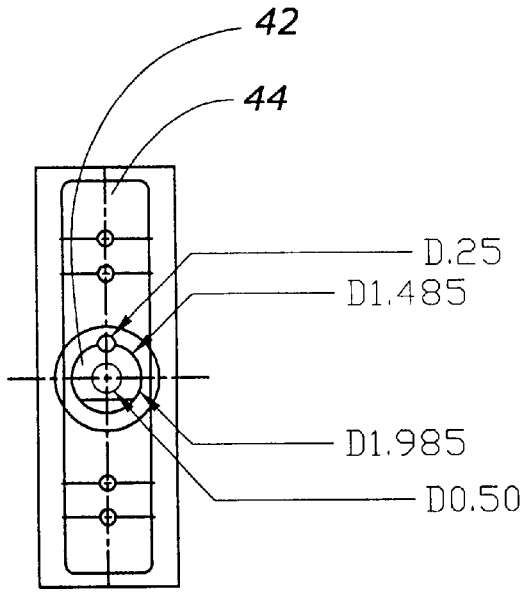
Figure 18:
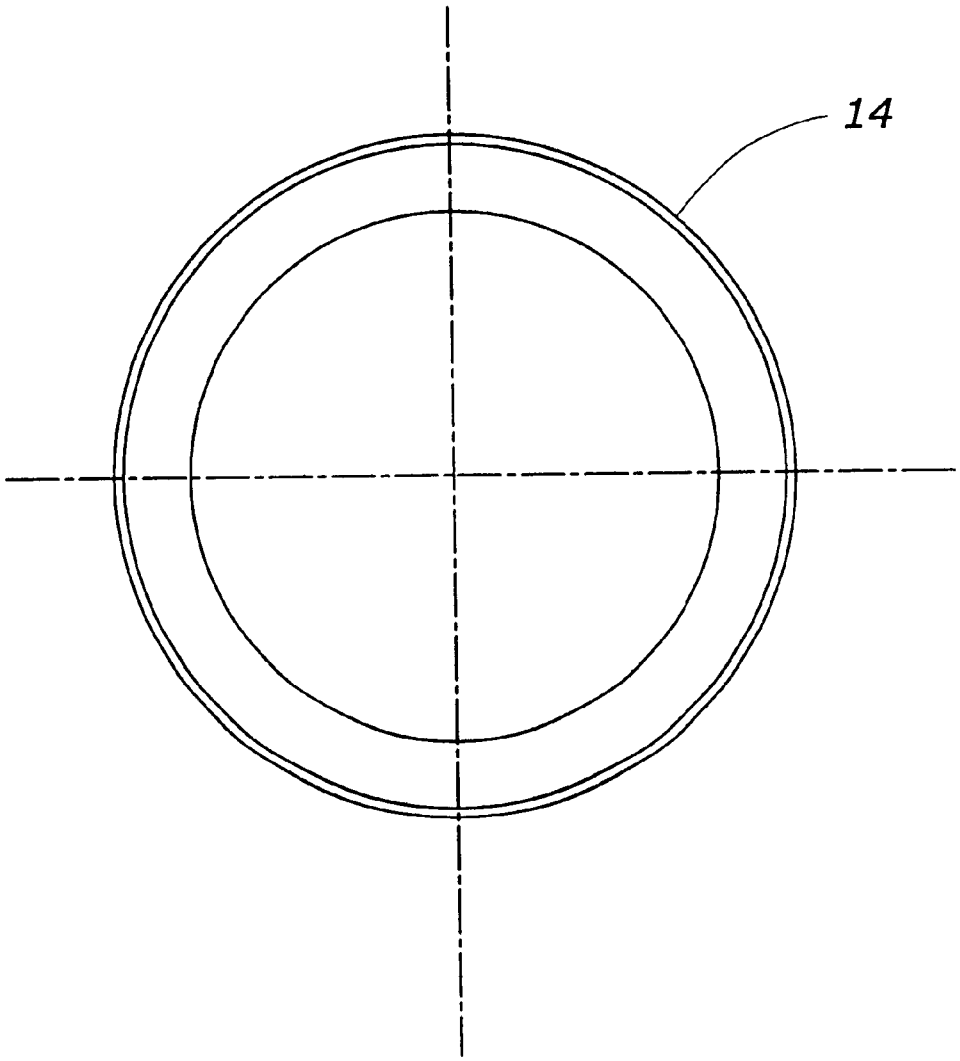
FIG. 18 is a plan view of top of pole section.
Figure 19:
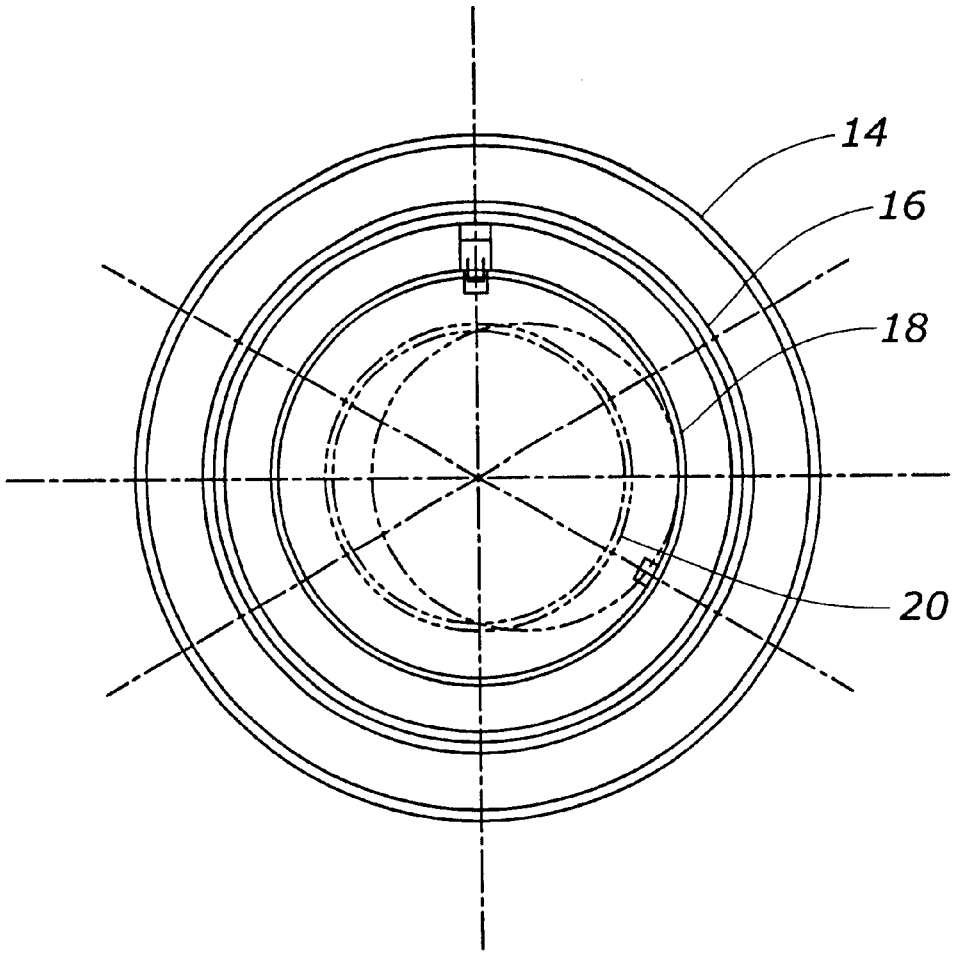
FIG. 19 is a top plan view of FIG. 1, showing a plurality of pole sections in a nested relationship.

FIG. 13 shows this relationship of the top ends of the pole sections. Note that annular ring 38 at the top of base pole section 14 is spaced a distance 70 from the very upper edge of base pole section 14. Similarly, annular rings 38B and 38C, associated with locking mechanisms 34B and 34C of pole sections 16 and 18, are spaced distances 72 and 74 respectively from the very tops of pole sections 16 and 18 respectively.

As shown in FIGS. 14–18, this arrangement allows catch pins 42 to abut and sit upon the top edge of a preceding pole section so that catch pins 42 are supported by the preceding pole section instead of annular plate 38.

Figure 20:
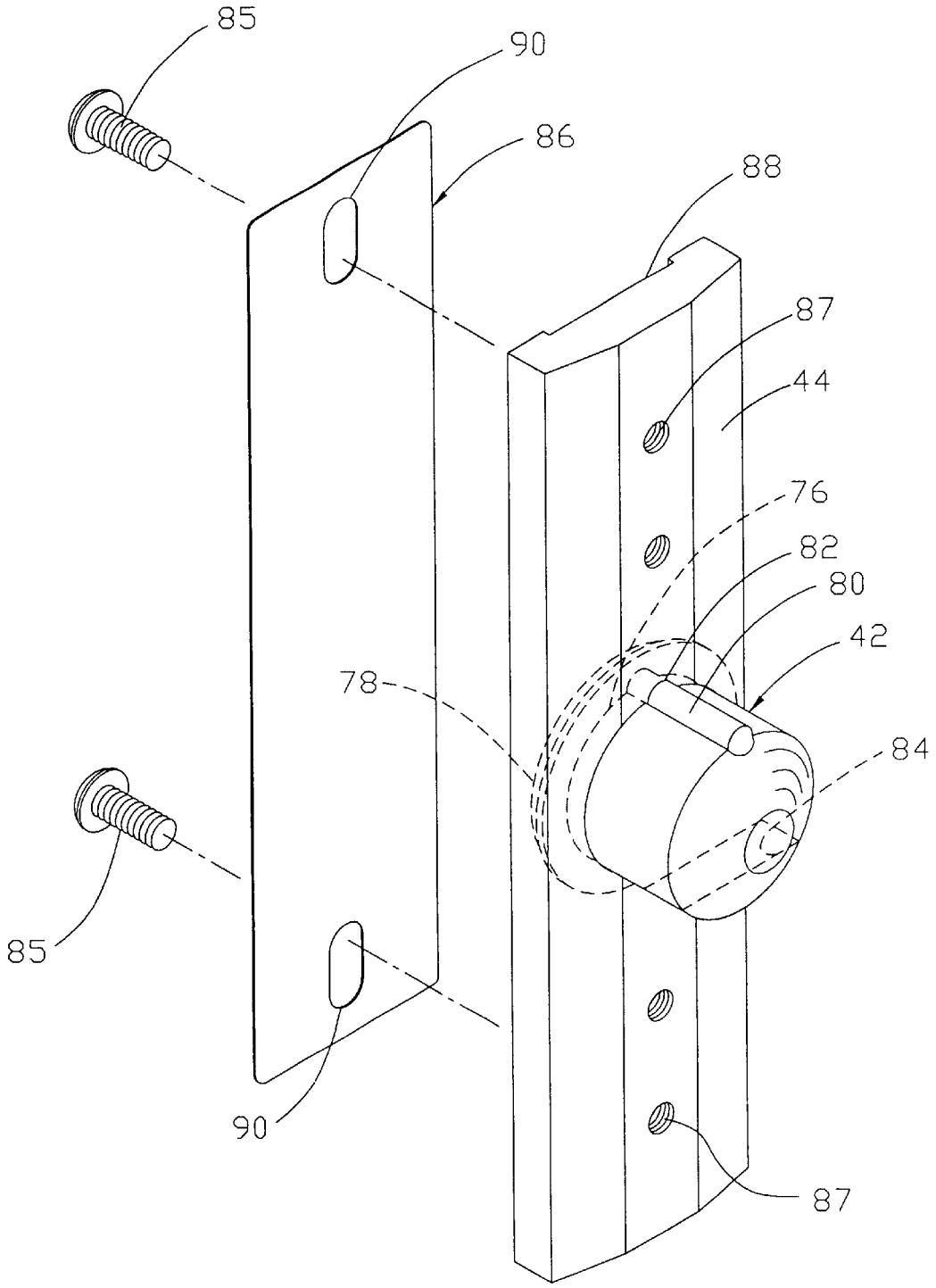
FIG. 20 is an enlarged perspective view of a locking or catch pin of FIG. 17 and its mounting block and spring.
Figure 21:
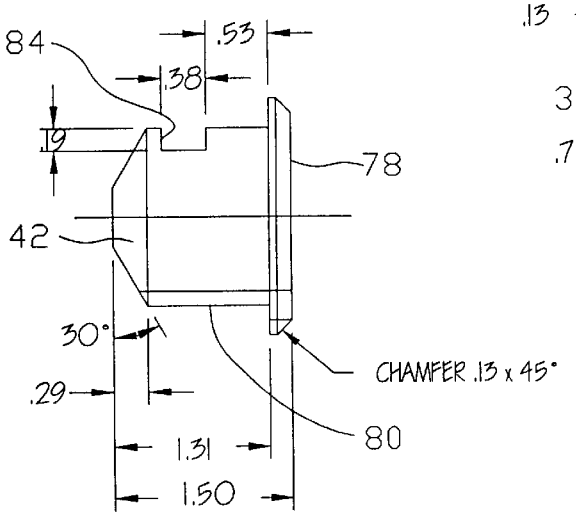
FIG. 21 is a side elevational view of the pin of FIG. 20.
Figure 24B:
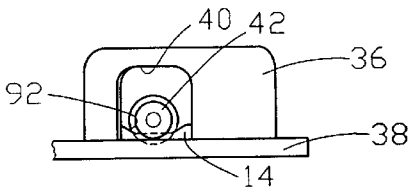
FIG. 24B is an isolated elevational view of the latch pin and latch catch of FIG. 24A.
Figure 24D:
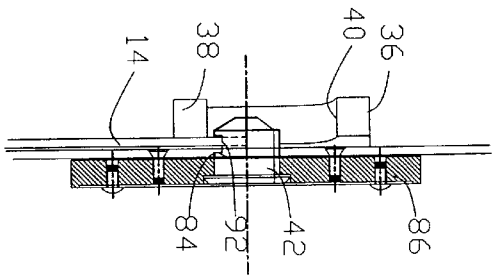
FIG. 24D is a section view taken along line 24D–24D of FIG. 24C.
Figure 24A:
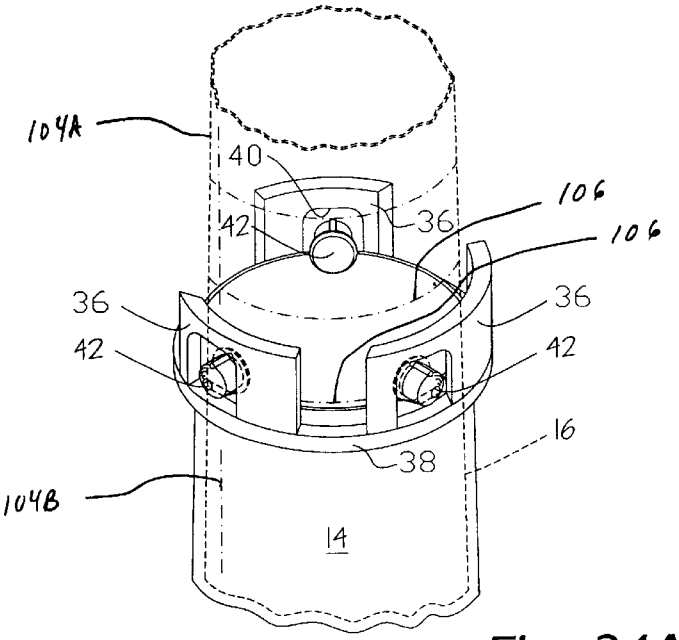
FIG. 24A is an enlarged perspective view of two pole sections in an extended and locked position.
Figure 24C:
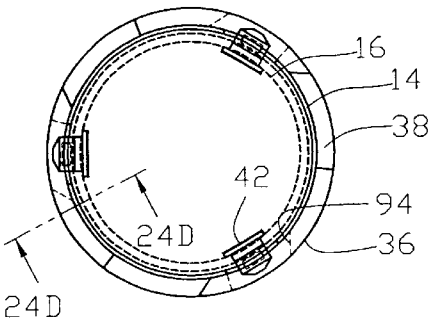
FIG. 24C is a top view of FIG. 24A.
Figure 25B:
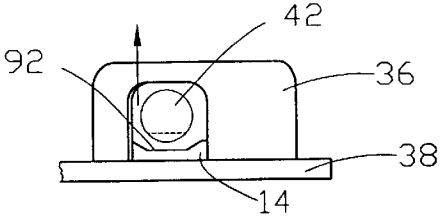
FIGS. 25A–D are similar to FIGS. 24A–D except that the two pole sections are moved slightly relative to one another along the longitudinal axis.
Figure 25D:
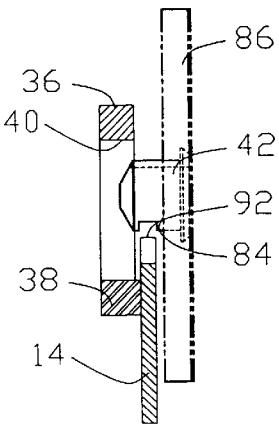
Figure 25A:
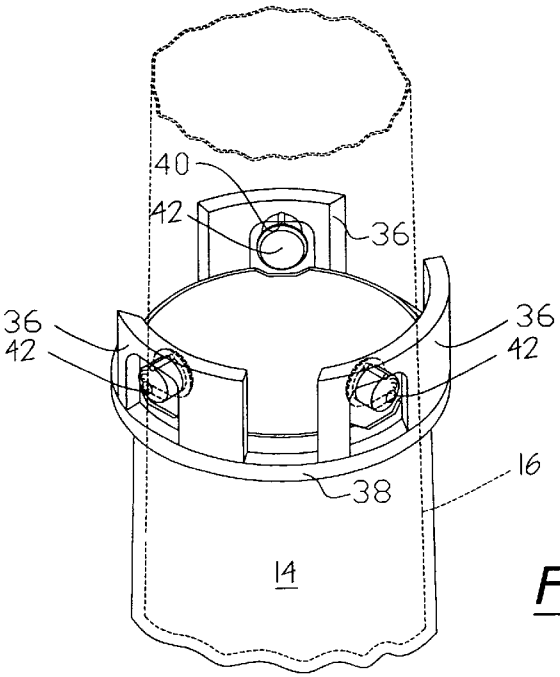
Figure 25C:
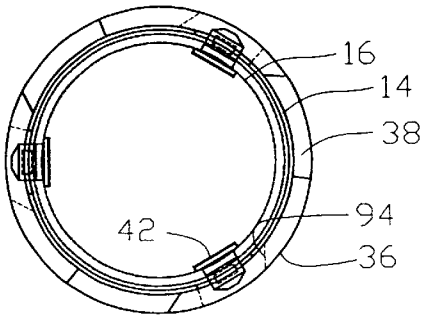
Figure 26B:
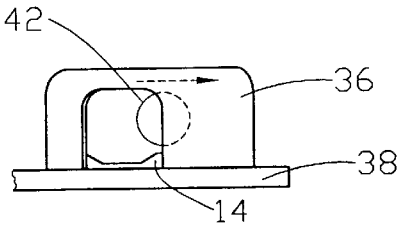
FIGS. 26A–26D are similar to FIGS. 25A–25D except that the two pole sections are rotated slightly relative to one another.
Figure 26D:
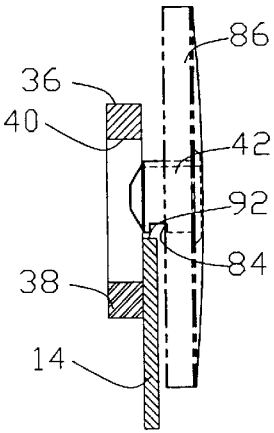
Figure 26A:
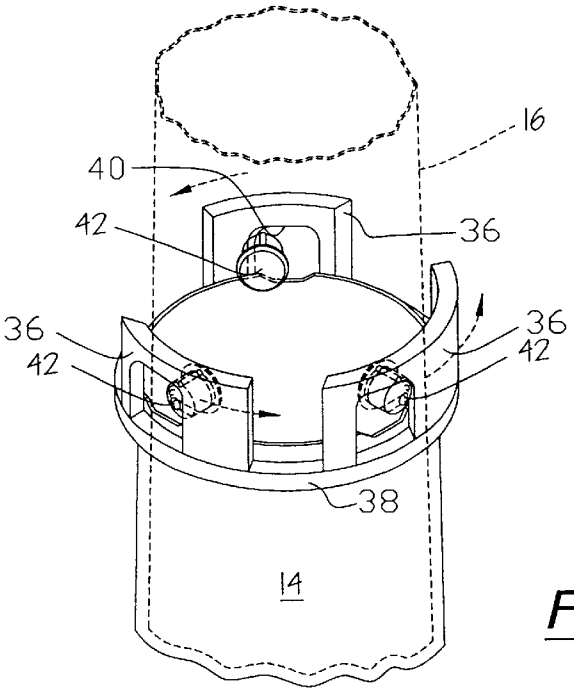
Figure 26C:
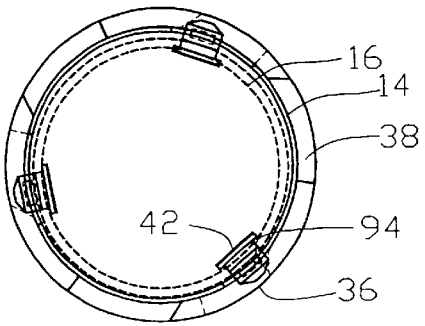
Figure 27B:
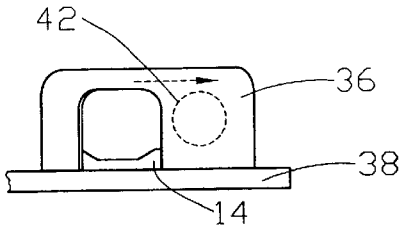
FIGS. 27A–27D are similar to FIGS. 26A–26D except that the two pole sections are rotated slightly more relative to one another.
Figure 27D:
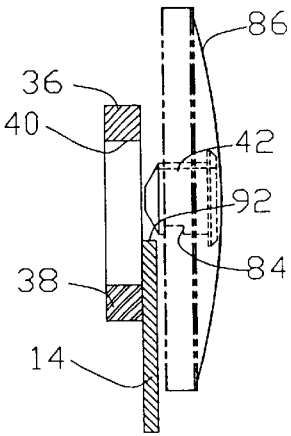
Figure 27A:
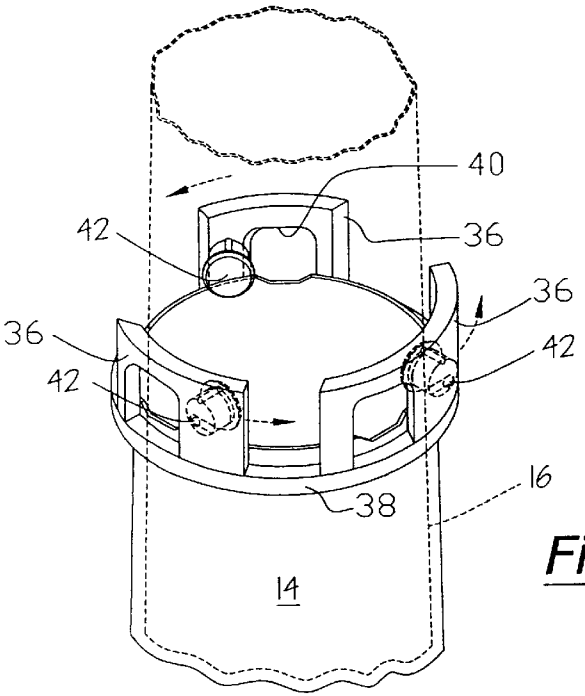
Figure 27C:
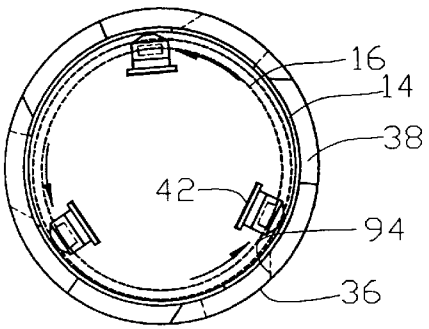
Figure 28B:
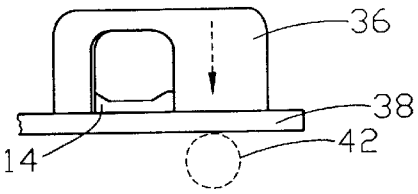
FIGS. 28A–28D are similar to FIGS. 27A–D but show two pole sections being slightly telescopically retracted relative to one another.
Figure 28D:
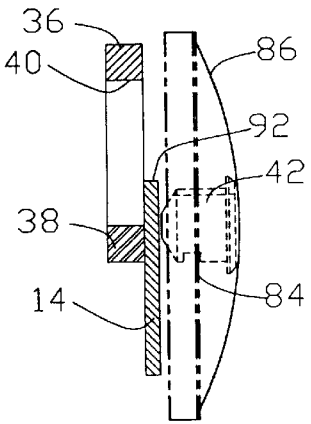
Figure 28A:
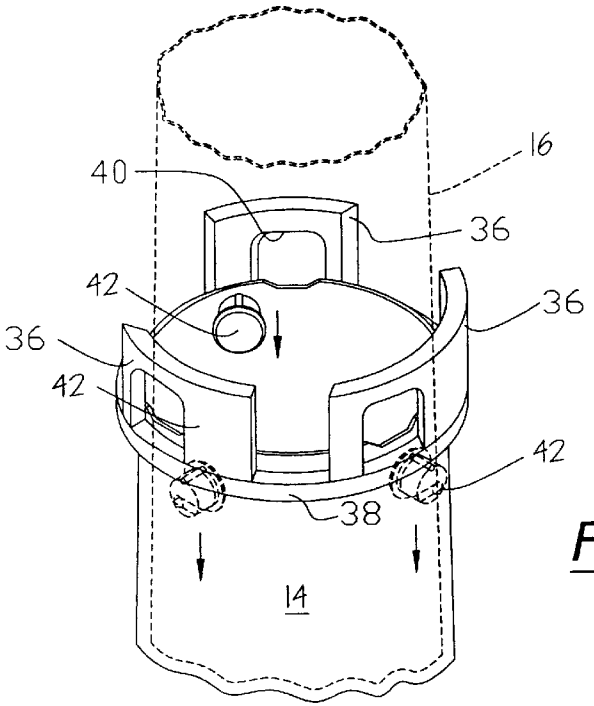
Figure 28C:
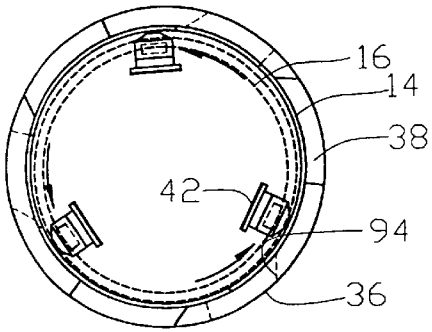
Figure 29B:
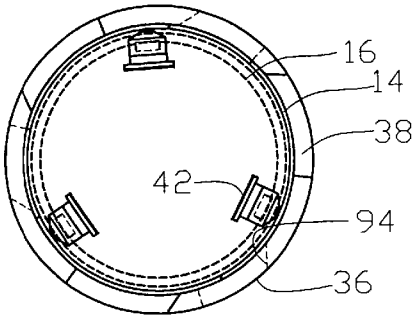
FIGS. 29A–29C are similar to FIGS. 28A–28D but show two pole sections completely retracted relative to one another.
Figure 29C:
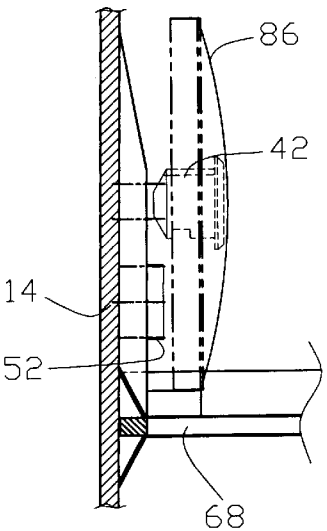
Figure 29A:
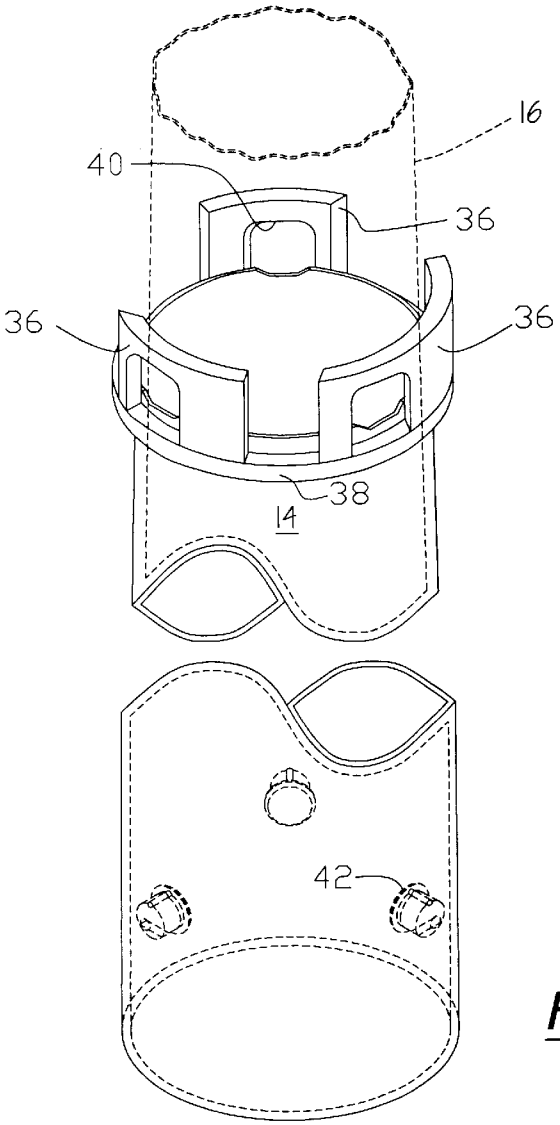

FIGS. 20 and 21 show catch pin 42 and catch blocks 44 in more detail. Catch block 44 has an opening 76 approximately at its center. Catch pin 42 matingly fits through opening 76 and includes a flange 78 that prevents pin 42 from moving all the way through opening 76. A guide rib 80 on the perimeter of catch pin 42 rides within notch 82 in opening 76 to prevent catch pin 42 from rotating in opening 76. A flat steel spring 86 is mounted in a channel 88 in the back of block 44 and holds catch pin 42 in the position shown in FIG. 20 (biases it outwardly from the front of block 44). A transverse cut-out or notch 84 exists in the catch pin 42, opposite guide rib 80. Transverse cut-out 84 is sized so that it can fit over the upper edge of the top of a pole section to further secure adjacent pole sections together when locked in extended positions. Note that the upper edge of pole section 14 can have curved cut-outs 92 (see e.g. FIG. 24B) to further secure catch pins 42 and retain pins 42 from lateral movement.

Spring 86 is held in position relative to block 44 by bolts or screws 85 extending through oblong apertures 90 near opposite ends of spring 86 and into threaded apertures 87 in block 44. Block 44 is approximately 6" long and 2" wide by ½" thick.

Pin 42 (e.g. A500 steel) is 1.485" outside diameter. Flange 78 is 1.985" outside diameter. Pin 42 is 1.5" in total length, including flange 78; without flange 78, pin 42 is 1.31" long. Slot 84 is 0.38" in width and spaced 0.53" away from flange 78.

Spring 86 is 7.63" long, 1.88" wide, and 0.015" thick. It is made of 0.015" spring steel. Pin 42 is made of A500 steel, as is block 44.

Figure 22:
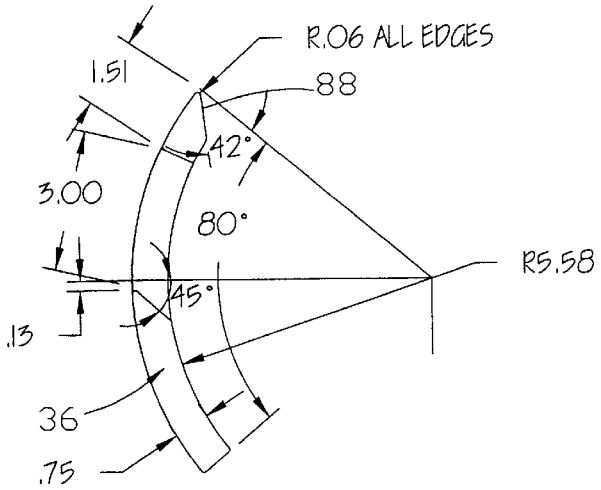
FIG. 22 is a top plan view of a latch catch for the catch pin of FIG. 4.
Figure 23:
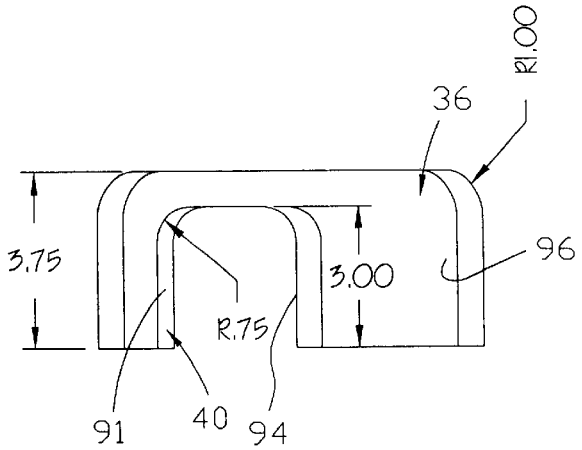
FIG. 23 is a front elevational view of FIG. 22.

FIGS. 22 and 23 depict more specifically latch catches 36. Latch catch 36 is made of A500 steel. It is approximately 7" long and curved along a radius of 5.58". It is 3.75" in width and 0.75" thick. As shown in FIGS. 22 and 23, opening 40 is 3" tall and has upper corners radiused at 0.75". One side of opening 40 (see reference numeral 91) is 1.51" inward from the one end of latch catch 36 and is essentially radially aligned relative to the center of curvature of latch catch 36. The other side 94 of opening 40 is 3" away from side 91, but is angled approximately 45° from the radial centerline of latch catch 36. Note also that the very end 98 of one side of latch catch 36 is sloped at 42° from the radial line shown in FIG. 22.

The purpose of such structure will become more apparent with reference to the operation of the locking mechanism 34 as will be described later.

Operation

FIGS. 24–29 illustrate operation of pole 10. FIG. 24A illustrates base pole section 14 and pole section 16 in an extended and locked position such as shown in FIG. 2. Catch pins 42 aligned with openings 40 in latch catches 36 and transverse cut-outs 84 in catch pins 42 are seated on the upper lip 92 of base pole section 14 (see in particular 24B and 24D).

In this position, longitudinal movement of pole section 16 relative to base pole section 14 is deterred because of the weight of pole section 16 (and other pole sections), pole top 22 and any items supported by pole top 22. Flat springs 46 of catch blocks 44 bias catch pins 42 radially outwardly. Even a force that would tend to move pole section 16 upward, would result in catch pins 42 hitting against the top of openings 40 and preventing further upward movement.

To collapse pole section 16 relative to base pole section 14, force is applied upwardly on pole section 16 to lift pole section 16 and thus catch pins 42 (and particularly transverse cut-outs 84 of catch pins 42) off of the top edge 92 of base pole section 14 (see FIGS. 25A–D).

Either base pole section 14 or pole section 16 is then rotated to move catch pins 42 in the direction of the arrows in FIGS. 26A–D. By particularly looking at FIGS. 26A and 26C, the beveled heads of catch pins 42, in combination with ramps 94 of openings 40, forces catch pins 42 by essentially a camming action to begin retracting.

This allows continued relative rotational movement of base pole section 14 and pole section 16 (see arrows in FIGS. 27A–D) until catch pins 42 are camped or retracted sufficiently to be out of openings 40 and sufficiently retracted so that transverse cut-outs 84 in catch pins 42 would not catch the top of base pole section 14. Catch pins 42 are forced inwardly against springs 86.

FIGS. 28A–D then illustrate that pole section 16 can be forced straight downwardly and catch pins 42 would not prohibit downward longitudinal movement of pole section 16 because they are moved sufficiently inwardly. Pole section 16 can then be retracted or collapsed into base pole section 14 to a position illustrated at FIGS. 29A–C, where it is noted that catch pins 42 ride along the interior surface of base pole section 14. Pole section 16 would be collapsed to the position shown in FIGS. 1 and 12 until the bottom of pole section 16 strikes the lower limit/stop 68.

The preceding has described how pole section 16 can be unlocked and retracted into base pole section 14. The same steps would be used to unlock and retract pole section 18 relative to pole section 16 and pole section 20 relative to pole section 18.

The reverse procedure would be practiced to extend pole 10 from the retracted, collapsed state of FIG. 1 to the fully extended state of FIG. 2.

It is generally preferred to extend the upper-most pole section 20 first, followed by the second-to-upper-most pole section 18, followed by the third-to-upper-most pole section 16. One way to do so would be to use mechanical means (e.g. a lift truck or other mechanism(s) to grasp structure (for example, ears 100 (with holes 102) on opposite sides of the top of a pole section—see FIG. 14B), and raise that pole section until catch pins 42 are in any of the positions of FIGS. 27A–D, 26A–D, or 25A–D. Ultimately, one would rotate the pole sections at issue to get catch pins 42 in the position shown in FIGS. 25A–D—where catch pins 42 are aligned with openings 40 in latch catches 36, but are near the top of openings 40. Once so aligned, the upper pole section can be lowered such that transverse cut-outs 84 in catch pins 42 would seat upon the upper edge of the lower of the two pole sections (FIGS. 24A–D).

The next lowest pole section could then be grasped by the mechanism and raised and locked in a similar manner. This procedure would then continue until pole 10 is fully extended.

The structure and the amount of work needed to extend and lock pole sections in this manner is relatively minimal and can be accomplished with mechanisms such as lift or lull trucks instead of more costly and cumbersome cranes or other similar equipment. Alternatively, a dedicated mechanical device or devices, or a self contained extension device mounted directly on the pole, could be used to slide pole sections from retracted to extended positions or vice versa. The installer could use bar or pole 49 (FIG. 5) to rotate section 14 while the device holds the extended section form rotation, so that the catch latches move to capture the catch pins and thus lock the extend section in extended position. Other methods are possible. The lift mechanism(s) can be moved from pole to pole. The pole sections can include markings to help with rotational and longitudinal alignment. For example, as roughly illustrated in FIG. 24A, a vertical line 104A could be marked on pole section 16 and a vertical line 104B on pole section 14. Marks 104A and 104B could be placed so that when aligned with one another, pins 42 would be aligned with openings 40 in latch catches 36. This would assist the installer, who normally is at or near the bottom of section 14, to know when alignment is reached. Similarly, horizontal indicia or lines 106 could be marked on section 16 to help an installer visually see how close to fully extended a pole section is. The foregoing is not the only way of extending and retracting pole 10, but is a very efficient way of doing so.

As has been described, this arrangement also does not require extremely close tolerances as the locking mechanisms 34 have built-in play or tolerance that allows quick and easy operation.

Options and Alternatives

It is to be understood that the aforementioned embodiment is but one form the invention can take. Alternatives, such as are within the skill of those of ordinary skill in the art, defined solely by the claims appended hereto.

For example, the invention is intended primarily for use with poles elevating items to substantial heights. By substantial heights, it is meant on the order of 35' or more. As a practical matter, the range could be up to on the order of 120' fully extended.

The precise dimensions of the pole sections and the locking mechanisms are to be designed for the particular height of pole, working conditions and items to be elevated. Base 12 can be either permanent or portable. Base pole section 14, for example, could use some other type of mechanism or structure for attachment to a base. Examples would be bolts, direct burial in the ground, or other connections. Pole 10 can be used to elevate a variety of items or devices. One example given is lighting fixtures such as wide-area, high intensity lighting fixtures of the nature disclosed in U.S. Pat. No. 5,398,478. Other items are possible, including, but not limited to electrical wires, communications devices or antenna, communication wires, beacons or warning lights.

Note that the invention has many advantages. One example is that it allows non-remote aiming of light fixtures with less costly equipment than large cranes or the like. Another example relates to permanent lighting. The collapsible pole allows for easy lamp replacement.

In the preferred embodiment, the pole sections are tapered with succeeding sections generally smaller in diameter than preceding sections. It should be noted however that in the preferred embodiment, the smallest diameter of each preceding section is smaller than the largest diameter of its succeeding section. The sections are made to leave some clearance when extended relative to one another to allow for rotation between the sections.

However, it is possible to use the concepts discussed herein where the tapering of sections is in the opposite direction. Still further, a middle pole section could have the largest diameter, and preceding and succeeding sections smaller diameters, so that they retract into the middle member. The sections do not necessarily have to be tapered, but it is preferred.

Figure 21C:
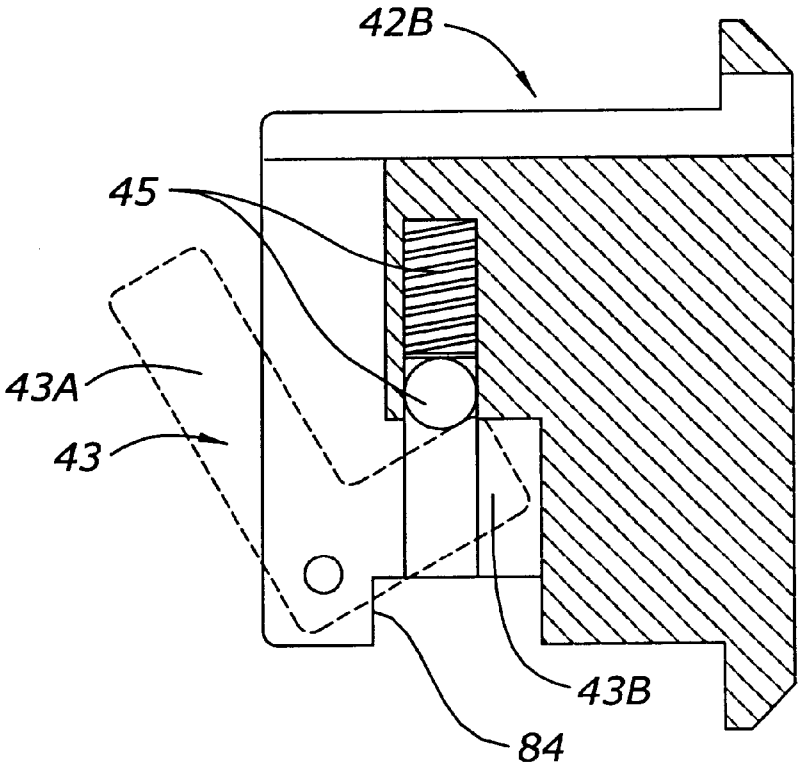
FIG. 21C is similar to FIG. 21B but shows the catch pin in a different state.
Figure 21B:
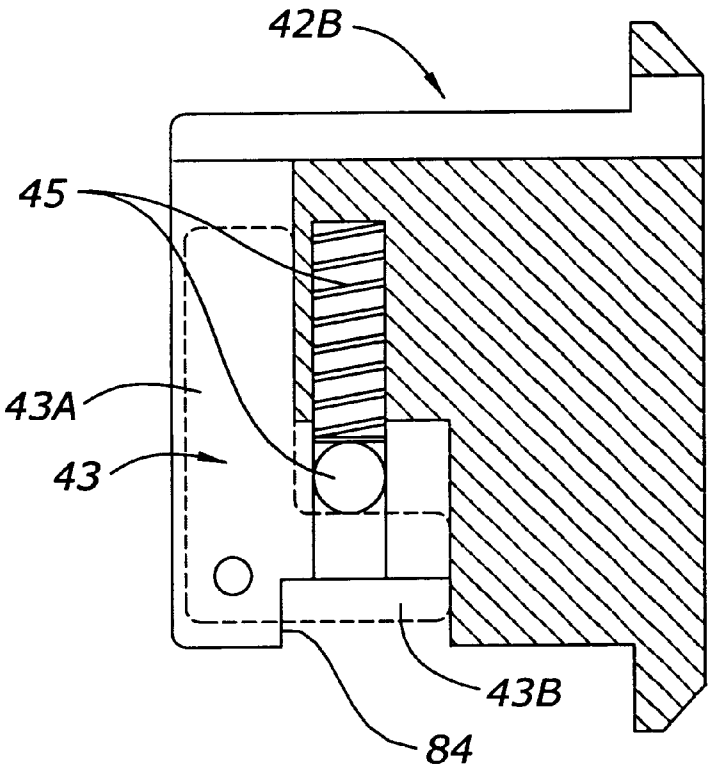
FIG. 21B is an enlarged side elevational sectional view of an alternative embodiment for a catch pin.

FIGS. 21B and C illustrate an alternative embodiment for a catch pin. As shown in FIGS. 21B and C, alternative embodiment catch pin 42B includes what will be called a flag 43 pivotally mounted interiorly of the front end of pin 42B. FIG. 21B shows flag 43 in its normal state. Internal spring and ball combination 45 pushes downwardly on the short leg 43B of flag 43 to keep it normally in the position of FIG. 21B. However, when pin 42B extends through opening 40, and latch catch 36 and transverse cutout 84 of pin 42B engages the top of a pole section, that top edge of the pole section then enters transverse cutout 84 of pin 42B, abuts short arm 43B of flag 43 and overcomes the downward force of spring and ball 45 to pivot flag 43 to the position shown in FIG. 21C. In that position long arm 43A of flag 43 would pivot out of retraction in catch pin 42B. This would provide a visual indication to workers that pin 42B is appropriately seated on the top of a pole section to assist the operators to confirm the extended pole sections are locked. Flag 43 could be metal or other material. It could be painted or otherwise marked to make it highly visually perceptible, even from substantial distances.

Previously stop blocks 68 were discussed in association with limiting the travel of nested pole sections within one another. Alternatively, stop blocks could be positioned on the outside around the top of each pole section, instead of on the inside bottom. Such alternative stop blocks would function the same way. They would limit how far down each pole section would move into the preceding pole section by extending the diameter of, and perhaps slightly outside the diameter of, the preceding pole section. Additionally, they could be spaced apart around the top of a pole section in a manner that would not allow more than a certain rotation of the succeeding pole section. For example, some type of extension or feature of the succeeding pole section could extend outwardly and limit rotation of succeeding pole section relative to the preceding pole section to the extent of spacing of stop blocks.

What is claimed:

1. An elongated pole extendable to substantial heights comprising:

(a) a lower end adapted for mounting to a support;

(b) a first tubular pole section;

(c) a second pole section adapted to nest relative the first pole section between a collapsed position where a substantial amount of the second pole section is nested relative to the first pole section but a portion of the second pole section is above the first pole section and telescopically extend along the longitudinal axis to an extended position where a substantial amount of the second pole section is extended from the first pole section;

(d) a releasable locking member mounted on the pole and comprising a component that engages said first and second pole sections when the second pole section is in the extended position to releasably lock the second pole section against longitudinal movement relative the first pole section;

(d1) the locking member further comprising a retractable piece mounted on the second pole section and moveable between a retracted position towards the interior of the second pole section and an extended position outwardly of the second pole section;

(d2) a biasing member to bias the retractable piece to the extended position;

(d3) a receiver on the first pole section, the receiver including an opening adapted to receive the retractable piece when aligned therewith;

(d4) a camming surface on the receiver adapted to cam the retractable piece to a retracted position when first and second pole sections are rotated relative to one another.

2. The pole of claim 1 wherein the pole is greater than thirty five feet in length in the extended position.

3. The pole of claim 1 further comprising a third pole section adapted to nest inside the second pole section between a collapsed position where a substantial amount of the third pole section is inside the second pole section but a portion of the third pole section is above the second pole section and telescopically extend along the longitudinal axis to an extended position where a substantial amount of the third pole section is extended outside the second pole section.

4. The pole of claim 3 wherein the second pole section is collapsible into the first pole section when the third pole section is collapsed into the second pole section.

5. The pole of claim 3 further comprising a fourth pole section adapted to nest inside the third pole section between a collapsed position where a substantial amount of the fourth pole section is inside the third pole section but a portion of the fourth pole section is above the third pole section and telescopically extends along the longitudinal axis to an extended position where a substantial amount of the fourth pole section is extended outside the third pole section.

6. The pole of claim 3 further comprising a one or more additional pole sections adapted to nest inside preceding pole sections between a collapsed position where a substantial amount of each additional pole section is inside a preceding pole section but a portion of each additional pole section is above the preceding pole section and telescopically extends along the longitudinal axis to an extended position where a substantial amount of the additional pole section is extended outside the preceding pole section.

7. The pole of claim 1 wherein the first and second pole sections are tapered tubular steel.

8. The pole of claim 7 wherein the taper is wider to narrower from the lower end upward.

9. The pole of claim 1 wherein the first pole section is a base pole section including the lower end.

10. The pole of claim 1 wherein the second pole section is an upper pole section including an upper end adapted to receive a mount for a member to be elevated.

11. The pole of claim 1 further in combination with a base, wherein the lower end of the pole is adapted to slip fit on a base comprising a tapered upper end and a lower end.

12. The pole and base of claim 11 wherein the lower end of the tapered base is adapted to be fixed into the ground.

13. The pole and base of claim 11 further in combination with a support, wherein the lower end of the base is adapted to be removably mountable to the support.

14. The pole, base and support of claim 13 further comprising a support which is fixed in the ground.

15. The pole, base and support of claim 13 further comprising a support which is moveable.

16. The pole of claim 1 further in combination with a mounting member, wherein the upper end of the pole is adapted to receive a mounting member to which can be attached a member to be elevated.

17. The pole and mounting member of claim 16 further comprising the mounting member being attached to the upper end of the pole.

18. The pole and mounting member of claim 17 further comprising a member mounted on the mounting member.

19. The pole and mounting member of claim 18 wherein the member is a lighting fixture.

20. The pole and mounting member of claim 19 wherein the member is a high intensity wide area lighting fixture.

21. The pole and mounting member of claim 20 further comprising a plurality of lighting fixtures mounted on one or more mounting members attached to the upper end of the pole.

22. The pole and mounting member of claim 16 wherein the mounting member comprises a removable pole top adapted to support one or more items to be elevated.

23. The pole and mounting member of claim 22 wherein the mounting member has a lower end adapted to be slip fit over the upper end of the pole.

24. The pole of claim 1 further comprising a stop member mounted on the interior of a pole section to form a lower limit for nesting of another pole section in said pole section.

25. The pole of claim 1 further comprising a centering member mounted on the interior of a pole section to center another pole when nested within said pole section.

26. The pole of claim 1 wherein the releasable locking member comprises a component moveable between a position allowing relative longitudinal movement between said first and second pole sections, and a position disallowing at least some relative longitudinal movement between said first and second pole sections.

27. The pole of claim 26 wherein the component further comprises a retractable piece mounted on the second pole section and moveable between a retracted position towards the second pole section and an extended position outwardly of the second pole section.

28. The pole of claim 27 wherein the retractable piece comprises a pin.

29. The pole of claim 27 wherein the component further comprises a receiver mounted onto the first pole section, the receiver including an opening adapted to receive the retractable piece when aligned therewith.

30. The pole of claim 29 further comprising a plurality of retractable pieces and receivers.

31. The pole of claim 29 further comprising a biasing member to bias the retractable piece to the extended position.

32. The pole of claim 31 wherein the biasing member is a spring.

33. The pole of claim 29 wherein the receiver further comprises a camming surface adapted to cam the retractable piece to a retracted position when the retractable piece is moved across the camming surface.

34. A telescopically extendable and retractable pole for elevating a device to substantial heights comprising:

(a) a plurality of pole sections each having bottom and top ends and sized to telescopically nest within one another;

(b) in a retracted position the top ends of each pole section partially extending outward of a preceding pole section (c) in an extended position, each pole section including a releasable locking member to lock said pole section in said extended position (d) the locking member comprising a retractable piece mounted on the one of said pole sections and moveable between a retracted position towards the interior of said one of said pole sections and an extended position outwardly of said one of said pole sections; a biasing member to bias the retractable piece to the extended position; a receiver on another of said pole sections, the receiver including an opening adapted to receive the retractable piece when aligned therewith; a camming surface on the receiver adapted to cam the retractable piece to a retracted position when said one and said another pole sections are rotated relative to one another.

35. The pole of claim 34 wherein pole exceeds 35 feet in the extended position.

36. The pole of claim 34 wherein the pole sections are tubular steel.

37. The pole of claim 36 wherein the pole sections are tapered from wider to narrow from bottom to top of the pole.

38. The pole of claim 34 wherein the locking member comprises a piece moveable relative to two adjacent pole sections between a position allowing relative longitudinal movement between the two adjacent pole sections and a position disallowing unrestricted longitudinal movement.

39. The pole of claim 38 wherein the locking member further comprises a receiving member on one of the two pole sections adapted to receive the piece to effectuate locking of the two pole sections when the piece is positioned therein.

40. A method of elevating an item to substantial height comprising:

(a) telescopically extending a plurality of tubular steel sections from a retracted position to an extended position;

(b) releasable locking the sections in place in the extended position by biasing a retractable piece mounted on the one of said sections to an extended position outwardly of said one of said sections; receiving and restraining against movement the retractable piece by a receiver on another of the sections when aligned with the retractable piece; camming the retractable piece to a retracted position when said one and said another pole sections are rotated relative to one another;

(c) attaching an item to be elevated to a section.

* * * * *